US006990917B2

(12) United States Patent
Boatman et al.

(10) Patent No.: US 6,990,917 B2
(45) Date of Patent: Jan. 31, 2006

(54) LARGE DIAMETER MOORING TURRET WITH COMPLIANT DECK AND FRAME

(75) Inventors: L. Terry Boatman, Houston, TX (US); Jerry L. McCollum, Hempstead, TX (US); Charles L. Garnero, Cypress, TX (US)

(73) Assignee: FMC/Sofec Floating Systems, Inc., Houston, TX (US)

( * ) Notice: Subject to any disclaimer, the term of this patent is extended or adjusted under 35 U.S.C. 154(b) by 293 days.

(21) Appl. No.: 10/325,122

(22) Filed: Dec. 19, 2002

(65) Prior Publication Data

US 2003/0121465 A1 Jul. 3, 2003

Related U.S. Application Data

(60) Provisional application No. 60/344,104, filed on Dec. 28, 2001.

(51) Int. Cl.
*B63B 21/00* (2006.01)

(52) U.S. Cl. ..... 114/230.12

(58) Field of Classification Search ..... 114/230.1, 114/230.12

See application file for complete search history.

(56) References Cited

U.S. PATENT DOCUMENTS 5,052,322 A 10/1991 Poldervaart et al. ..... 114/230
5,359,957 A 11/1994 Askestad ..... 114/230
5,515,804 A 5/1996 Pollack ..... 114/230
5,517,937 A 5/1996 Lunde ..... 114/230
5,746,148 A * 5/1998 Delago ..... 114/230.12
5,850,800 A * 12/1998 Commandeur ..... 114/230.12
5,860,382 A 1/1999 Hobdy ..... 114/230
6,164,233 A 12/2000 Pollack et al. ..... 114/230
6,263,822 B1 7/2001 Fontenot et al. ..... 114/230.12
6,269,762 B1 8/2001 Commandeur ..... 114/230.12

FOREIGN PATENT DOCUMENTS

NO 165285 1/1991

* cited by examiner

*Primary Examiner*—Sherman Basinger
(74) *Attorney, Agent, or Firm*—Gary L. Bush; Andrews Kurth, LLP

(57) ABSTRACT

A very large diameter turret for mooring a VLCC class FPSO vessel. A large diameter rail and wheel bearing system is disposed between a turret main deck and the hull of the vessel. The turret is designed for a flexibility to allow the turret main deck to conform to the sag or hog of the vessel so that excessive forces on the wheels of the bearing system are avoided. The turret's main deck, in a preferred embodiment, includes a center hub, an outer ring, and spokes between the hub and outer ring. A lower chain deck is preferably connected to the main deck by pillars or columns, or alternatively by riser tubes alone, or other structures that achieve the desired flexibility of the main deck.

35 Claims, 19 Drawing Sheets

FIG.6A
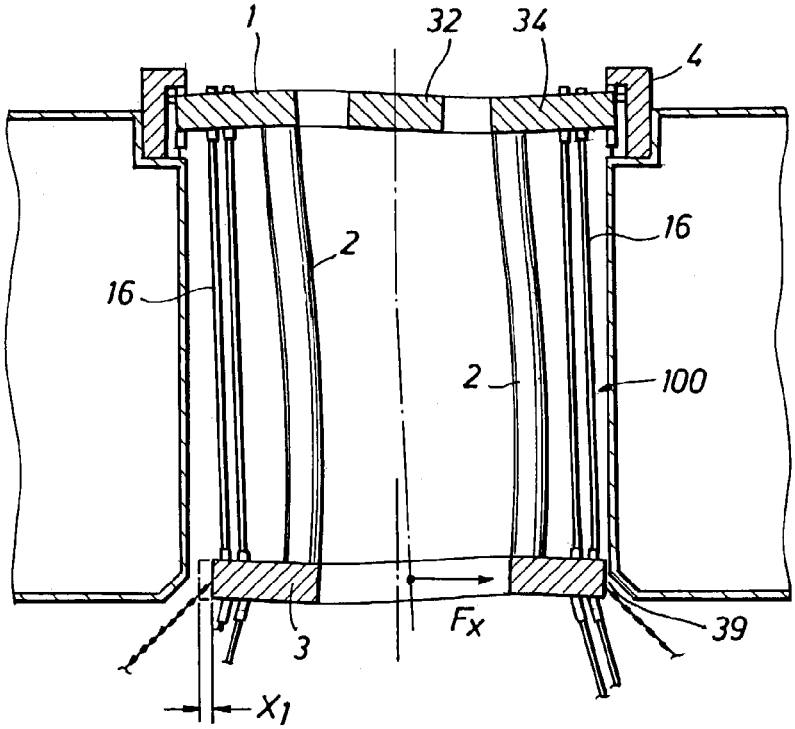
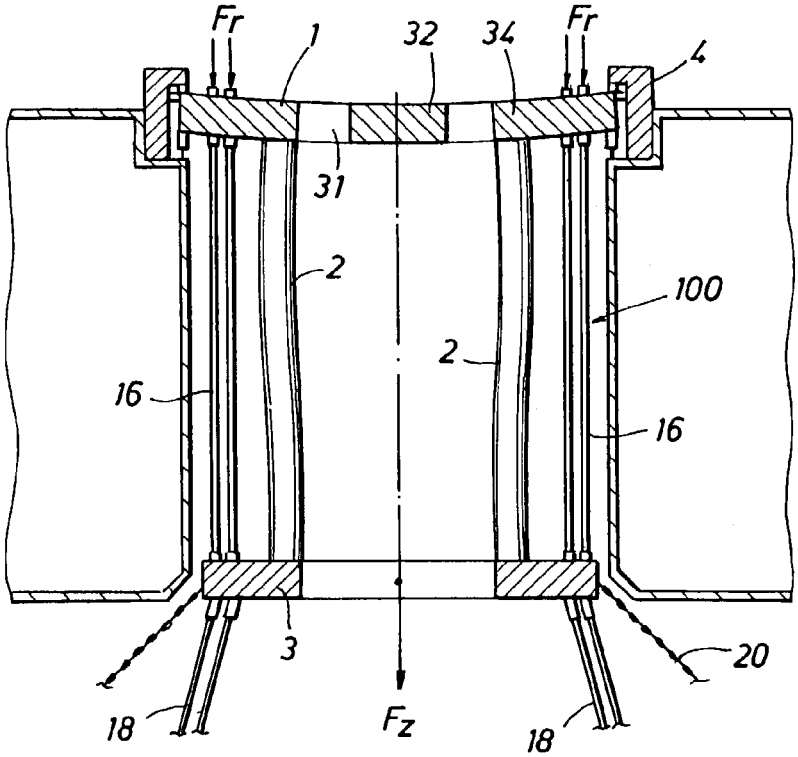
FIG.6B

FIG. 7A
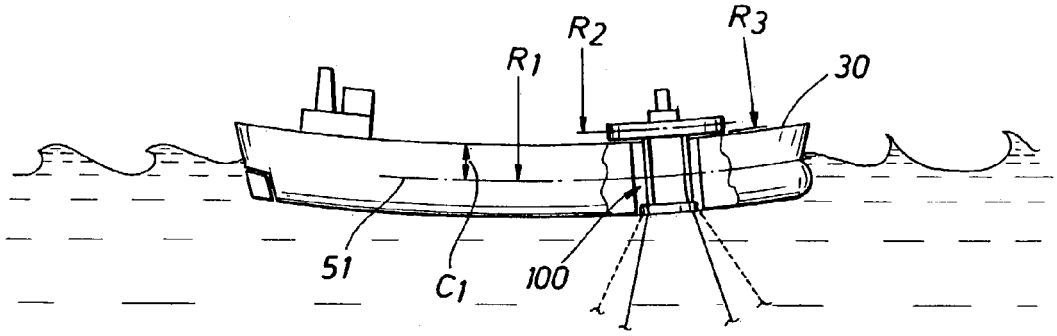
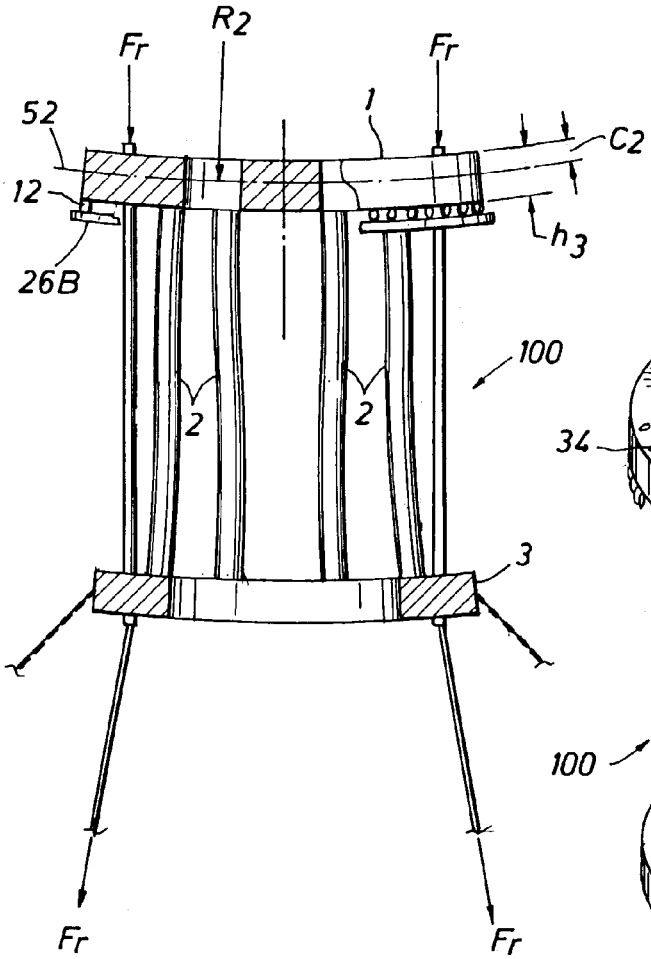
FIG. 7B
FIG. 7C
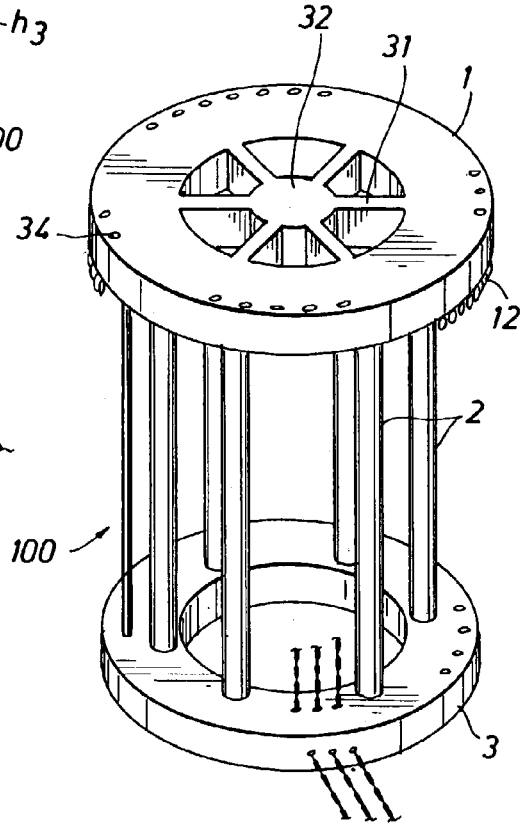

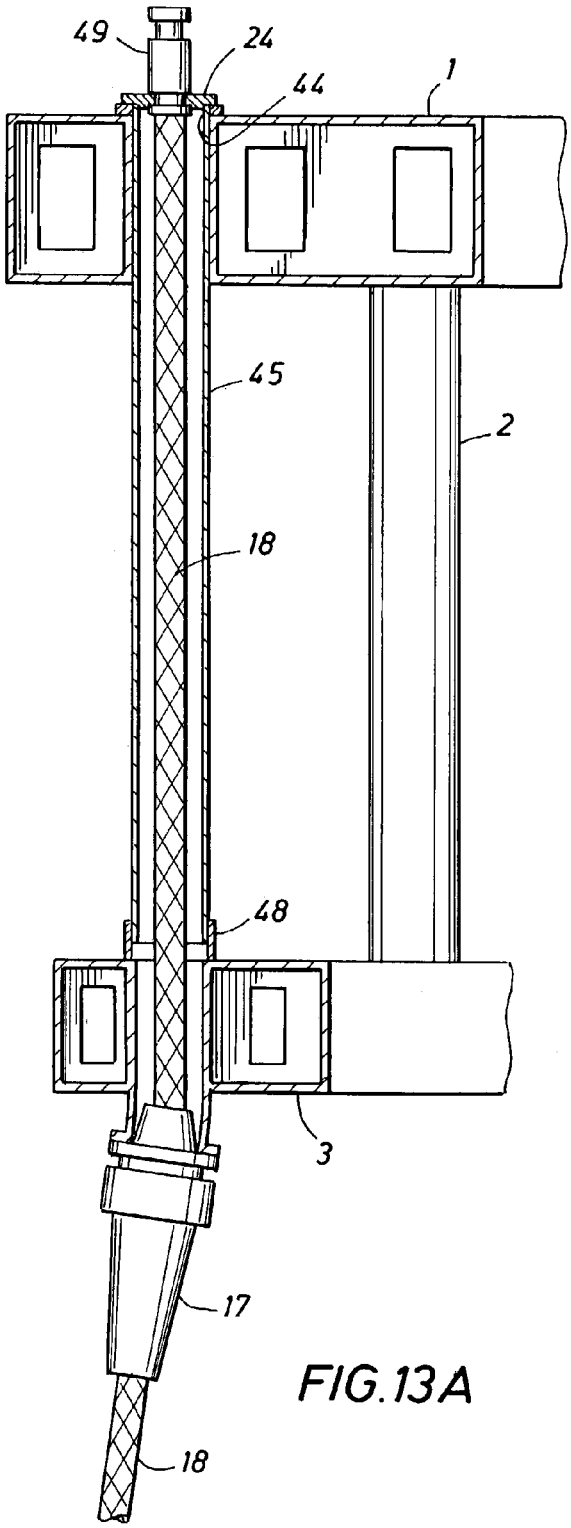
FIG.13A
FIG.19
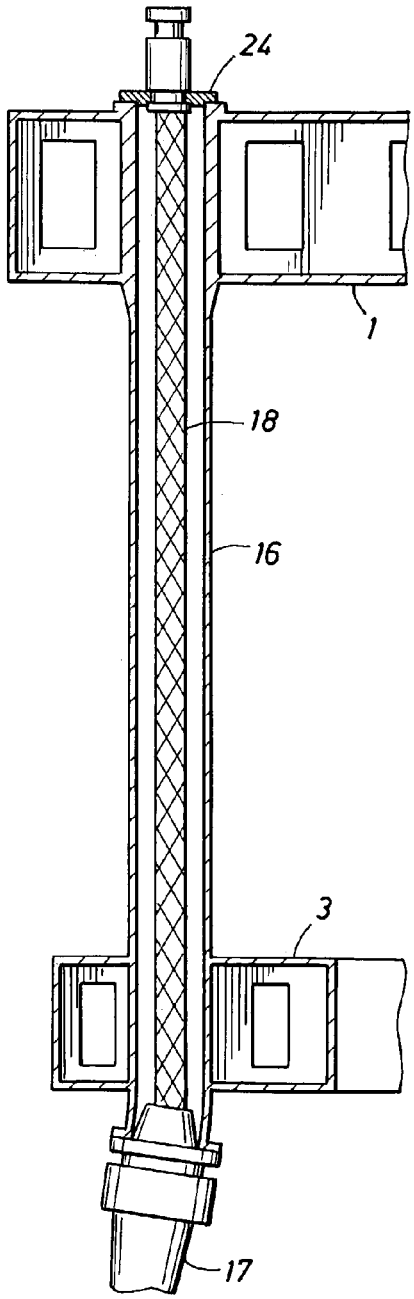

LARGE DIAMETER MOORING TURRET WITH COMPLIANT DECK AND FRAME

CROSS REFERENCE TO RELATED APPLICATION

This non-provisional application is based on Provisional Application Ser. No. 60/344,104 filed Dec. 28, 2001, the priority date of which is claimed for this application.

BACKGROUND OF THE INVENTION

1. Field of the Invention

This invention relates generally to mooring systems for offshore vessels and Floating Production Units ("FPUs") such as Floating Storage and Offloading vessels ("FSOs"), Floating Production Storage and Offloading vessels ("FPSOs"), Floating Storage Drilling Production and Drilling Units ("FPDSOs") and in particular to turret mooring arrangements, or systems, where a turret is rotatably supported on the vessel and where the turret is fixed to the sea bed by anchor legs so that the vessel can weathervane about the turret.

2. Description of the Prior Art

Turret mooring systems have been used for some time for FPUs and especially with FPSOs. FPSOs are production platforms typically constructed by reconfiguring existing tanker hulls. FPSOs are the most useful of FPUs in terms of water depth and sea conditions due to their variation in moorings and ship shape configurations. FPSOs are either spread moored (anchored directly to the seafloor and unable to completely weathervane and rotate around a center point of mooring), or they are attached to the seafloor via an internal or external rotatable turret that is moored to the seafloor for 360° weathervaning capability of the vessel. FIG. 1 is an illustration of a prior art turret moored FPSOV with the turret connected to the sea floor by groups of anchor legs L and risers R running from the sea floor to the turret for rotatable coupling to vessel pipes which run to storage holds.

FPSOs compete with other kinds of floating production units such as semi-submersibles, spars, and tension leg platforms. These other systems generally do not have large product storage capacity like FPSOs, but they do have the advantage of easily handling a large number of risers (the flexible pipes and control umbilicals connected between the production unit and subsea wellheads). Large numbers of risers are required for subsea oil fields when it is not desirable to use subsea manifolding connecting several wells together. The number of risers can be from the twenties to ninety or even more. The spread moored FPSO has the advantage of large product storage capacity and also has the space capability for large numbers of risers. One main disadvantage of the spread moored FPSO is the reduced availability for tandem offloading due to occasional bad weather conditions preventing a safe approach of the shuttle tanker to connect to the FPSO. In many locations the rough weather direction changes and can also cause undesirable rolling motions of the vessel that are problematic to the process equipment and to the crew. The competitiveness of all of the above floating production units depends on their advantages and disadvantages.

As mentioned above, the present invention is directed to a turret mooring arrangement, and in particular to a rotatably mounted turret of large diameter for the purpose of accommodating a large number of risers and for providing other advantages resulting from a large diameter geostationary turret. Such advantages are summarized below.

Prior turret mooring arrangements are known in the art that include turrets of small to moderate diameter where the problems associated with vessel hull deflections are considered. A moonpool (a cylindrical tube extending from top to bottom through a vessel hull) is required to contain and usually support the turret bearing and turret shaft. Flexure of the vessel hull due to sea conditions can cause undesirable structural deflections in the moonpool at the foundations for the turret bearings. This effect can be substantial and detrimental for large moonpool diameters, and unless steps are taken to mitigate such effects, the turret bearings will suffer from high concentrated loads.

Prior turret designers have sought to minimize turret diameters due to requirements of roller bearing assemblies requiring flat machined surfaces not exceeding a predetermined diameter. In such arrangement, designers have sought to isolate the flat bearing races with various elastic elements and apparatus in an effort to accommodate hull deflections. Other designers have attempted to provide bearing wheel and rail arrangements for vessel-turret designs. A few of the prior art attempts to solve the problem of vessel hull deflection as it affects bearing operation is presented below.

Norwegian Patent No. 165,285 shows a structural suspension that attempts to provide a satisfactory load distribution around a bearing wheel track that may not be flat. Independent radial arms are disclosed to which vertical and radial load rollers are attached. The radial arms attach to a circular ring that twists to add to the flexibility of the bending beam deflection of the arms. This concept is limited in load carrying capacity and limited to relatively small turret diameters.

U.S. Pat. No. 5,052,322 to Poldervaart illustrates a bearing fixed to a rigid ring that does not follow deformations of the hull of the ship. A cylindrical tube supporting the rigid ring tends to flex with the vessel hull while the bearing and turret remain relatively isolated from hull deflection. The benefits of this design diminish as the moonpool (or turret insert tube) diameter and hull deflections increase.

U.S. Pat. No. 5,515,804 to Pollack shows internal and external turret bearing arrangements with a generally rigid upper mount including a resiliently deflectable support structure that includes a plurality of elastomeric shear pads. These arrangements are also difficult and expensive to scale up to large diameters due to the proportionally increasing size and shear motion capacity of the shear pads.

U.S. Pat. No. 5,359,957 to Askestad illustrates radial bearing arms connected to a substructure in the turret which provide individual suspension and can absorb unevenness and deformations in the bearing. Rollers attached to the ends of the radial arms support the turret load. This design is also limited in load carrying capacity by the difficulty of attaching large numbers of rollers for high load capacity.

U.S. Pat. No. 5,517,937 to Lunde shows a turret arrangement for accommodating many risers in which the riser tubes are arranged at an angle to minimize the bearing diameter to about eight meters or less while the bottom diameter of the turret is made large in diameter to accommodate the necessary spacing of the risers below the turret. Minimizing the bearing diameter is one way of mitigating the effects of the previously mentioned deflections, but construction complexity and other disadvantages such as limited equipment space inside the turret result from this arrangement. As the numbers of risers increase, their weight eventually overcomes the available capacity of the smaller bearing diameters.

U.S. Pat. No. 5,860,382 to Hobdy illustrates a turret with radial bearing rollers arranged with spring assemblies that allow for unevenness of the radial wheel rail and maintain roller contact with their rail. This arrangement of turret and bearing is suitable for risers numbering thirty to forty, but may not be practical for a much larger quantity of risers. The limitation of larger turrets of this design is the low flexibility of the tube-shaped turret structure. The turret is vertically shear-stiff, and the wheel and rail system must therefore be designed for significantly increased loading per wheel to accommodate the out-of-flat condition of the vertically loaded wheel rails.

U.S. Pat. No. 6,164,233 to Pollack describes bearing devices that include hydraulic cylinders and pistons to support vertical loads that are arranged to accommodate vessel hull deformations.

U.S. Pat. No. 6,263,822 to Fontenot shows elastomeric pads arranged radially and vertically around the main bearing which rotatably supports a mooring turret. This arrangement for shear and compression of elastomeric pads serves to compensate for hull deflection at the main bearing. The elastomeric pads accommodate vertical and radial deflections of the hull. This design is also expensive and may be difficult to scale upward to a large size.

U.S. Pat. No. 6,269,762 to Commandeur illustrates a bogie wheel bearing support structure mounted on top of a moonpool tube that extends above the connection to the vessel hull to isolate the bearing structure from the hull deflections. Commandeur also shows elastically deformable elements (rubber filler) beneath the bogie wheels to help even out the load on the wheels. The very tall moonpool tube also serves to isolate radial hull deflections from the bearing assemblies.

The advantages of this invention will be more apparent by comparison to prior art turrets.

FIG. 2 shows a prior art large turret capable of supporting 43 risers that was supplied for a Petrobras Field Development offshore of Brazil. The illustration is of the turret parts loaded on a barge B for transport from the fabrication yard. The complex arrangement of the lower turret T can be seen in which the turret structure and all of the riser guide tubes are tapered toward the top end in an effort to reduce the upper bearing diameter. The turret structure is of rigid construction.

FIG. 3 is a drawing of a prior art turret supplied by SOFEC, Inc. for an offshore oil field in the South China Sea. The turret 200 has a cylindrical tube structure that is relatively rigid in bending and shear. The upper bearing structure and the turret are rigid in the radial and vertical directions. A spring suspension system supporting the upper bearing 202 in combination with a heavily reinforced bearing support 204 structure allows structural deflections of the vessel at the turret insert tube (moonpool) without overloading the bearing. The bearing is a three-row roller bearing mounted in a manner similar to the apparatus of U.S. Pat. No. 5,356,321 to Boatman. This turret arrangement is typical of many in the single point mooring industry utilizing a combination of a lower bearing 208 near the vessel keel with an upper bearing 202 located near the main deck of the vessel.

FIG. 4 is a drawing of a prior art turret designed and supplied by SOFEC, Inc. for an oil field offshore of Brazil. An upper bearing system, located near the main deck of the vessel, includes a radial wheel/rail bearing 210 and an axial wheel/rail bearing 212 to provide rotational support between the turret and the vessel. No lower radial bearing was provided. A wheel and rail bearing system was provided for the vertical load to withstand large loads, because hull deflections concentrate the load onto only a fraction of the wheels. The vertical load rollers were designed with sufficient excess capacity per roller to carry the total load on only a portion of the total number of rollers. Radial wheels mounted on springs that spread the load over many radial wheels accommodates the radial deflections. The turret is stiff in both the radial and vertical directions.

For small diameter turrets, an axial roller bearing assembly can be provided between the turret and the vessel. Such roller bearing assemblies require that the bearing races be flat, machined surfaces. Such races have in the prior art often been isolated from ovaling due to vessel sagging and hogging by various elastic arrangements between a lower bearing race and the vessel. As the diameter of the turret becomes very large, roller bearing assemblies are not feasible due to the inability to machine flat surfaces for the very large diameter. Wheel-rail assemblies can be installed between the turret and the vessel, as described above, but for very large turrets carrying a very large number of risers, the forces on certain wheels due to the sagging or hogging of the vessel can become so large as to make it impractical to provide a very large turret for accepting a very large number of risers. The above very large number of risers connotes a number of from 40 to 120 risers.

Summing up, the problems for designing a very large turret (VLT) in the past have been either of vertically and radially stiff construction combined with various expensive devices to isolate the bearing, or they are limited in their range of diameter and load carrying capacity. The problems associated with a relatively inflexible structure limits the economic benefits of a large diameter turret, requires larger bearing capacities, and tends to reduce the wear life of the bearings.

3. Identification of Objects of the Invention

A primary object of the present invention is to provide an economical turret arrangement that has inherent structural flexibility, thereby making practical a large diameter main bearing that supports a very large turret.

Another object of the present invention is to provide an economical large diameter turret mooring arrangement for an FPSO that will accommodate a very large number of risers (either flexible non-metallic pipe or rigid steel pipe flow lines) where the large number of risers greatly exceeds those presently known in the art.

Another object of the present invention is to provide a practical turret configuration of sufficient size that allows a weathervaning vessel to be used as a floating production unit (FPU) with at least as many risers as can be connected to a non-weathervaning FPU such as a spread moored ship-shaped vessel or a semi-submersible vessel.

Another object of the present invention is to provide a wheel and rail bearing arrangement for a very large turret (VLT) frame configuration that has sufficient flexibility so that vessel hogging and sagging deflection causes a maximum load per wheel to increase not more than preferably about 50 percent greater than would occur with the rails in a perfectly flat plane, and not exceeding 150 percent greater than would occur with the rails in a flat plane.

Another object of the present invention is to provide a turret with a flexible structural frame configuration that allows a sliding-type lower bearing of a diameter greater than 12 meters diameter to be used near the vessel keel elevation in combination with an upper bearing greater than about 14 meters diameter located near the vessel main deck.

Another object of the present invention is to provide a turret with a flexible structural frame configuration with elastomeric bumper pads attached to the lower turret near the vessel keel elevation in combination with an upper bearing greater than about 14 meters diameter located near the vessel main deck.

Another object of the present invention is to provide a turret with a flexible structural frame configuration that allows the optional installation of protective riser tubes between the chain table and the main deck without appreciably increasing the stiffness of the turret frame.

SUMMARY OF THE INVENTION

The objects identified above, as well as other features and advantages of the invention are provided by a turret configuration in which the turret includes an upper section, a lower section, and a coupling structure such as at least three vertical columns or riser tubes alone for coupling the upper and lower sections together. The turret mooring arrangement is rotatably supported on a vessel that floats at the surface of the sea and that can weathervane about the turret. The lower section of the turret is anchored by at least three mooring lines that extend to the sea floor for anchoring the turret in a substantially geostationary position.

The arrangement utilizes a known bearing system, that is, a wheel and rail system that can be manufactured economically in sizes larger than 14 meters diameter. The phrase, "very large turret" (VLT), as used herein, refers to turrets requiring moonpool diameters larger than about 14 meters and up to about 35 meters. The moonpool diameter is limited only by the available width of the vessel into which the moonpool (turret insert tube) is fitted. The turret frame is configured in a way that provides sufficient flexibility to allow the turret main deck to conform to the vessel deck flexure shape as the vessel bends in the so-called "hogging and sagging" conditions. The bending flexure of the vessel hull causes the bottom or lower supporting surfaces on the vessel on which the wheels or rollers are supported to elastically flex and not remain in a flat plane. The load carrying frame members of the turret flex in concert with the vessel hull due to turret loads and thereby spread the loads to turret mounted upper rails for the wheels more uniformly than is possible with a stiff turret frame.

The upper section of the turret includes an axial/radial bearing assembly. This assembly permits the vessel to weathervane about the turret while resisting loadings caused by weather conditions, including sea conditions, causing the vessel to heave, pitch, roll, and yaw in the sea. The bearing assembly uses the commercially available Amclyde type flanged wheel and rail construction that can be manufactured economically for rail sizes larger than 12 meters diameter. The bearing foundation or support structure attached to the vessel hull bends and flexes with the vessel hull. The main deck of the turret is capable of flexing under the vertical load of the turret weight, mooring legs, and the weight of the risers and due to its flexible design follows the flex of the vessel. Certain geometric ratios such as main deck thickness to diameter; main deck thickness to depth of vessel hull; and column diameter to column length are required to be within certain ranges to provide the required flexibility without causing detrimental large stresses in the frame members.

The lower section of the turret includes a chain table to which mooring legs are attached, a structural coupling arrangement such as vertical columns which connect the chain table to the main deck, and riser tubes which protectively enclose the risers between the chain table and the main deck. An alternative embodiment of the invention places elastomeric bumper units at the outside diameter of the chain table to occasionally react against the inside of the moonpool.

Existing tanker vessels in the (Very Large Crude Carrier) VLCC class are available in the industry for FPSO conversion. The hull width of the VLCCs range from 50 meters to as much as 70 meters beam width. These vessels, with moonpool diameters of up to about 30 to 35 meters, can accept turrets that are practical according to the invention and that are large enough to accommodate between forty and one hundred twenty risers arranged in not more than two concentric rows at the bottom of the turret.

This invention, as defined below by the claims, makes possible a Very Large Turret (VLT) for a very large crude carrier (VLCC) converted into a weathervaning FPSO vessel. A weathervaning vessel is advantageous as compared to a spread moored vessel, because it provides safer shuttle tanker mooring for tandem offloading and more up-time for offloading. A VLT, i.e., one capable of handling between forty and one hundred twenty risers, has many advantages. All such advantages result from the large bearing diameter in combination with a bearing foundation and bearing arrangement which rotatably couples the vessel to a relatively flexible turret (as compared to prior turrets) capable of conforming to hogging and sagging deflections of the vessel hull. Advantages of the VLT according to the invention are summarized below.

1. The increased riser capacity allows a deep water field operator to no longer be required to use subsea manifolding because of space limitations on the turret. This feature provides maximum flexibility for field layout.

2. The VLT economically provides sufficient space for oversized riser tubes that allow maximum flexibility in riser location at the turret.

3. The increased space on the turret for manifold modules allows utilization of conventional valves rather than higher cost compact values.

4. The manifold module can be large enough for choke valves in all production and test situations. This feature allows all production and test swivels to be of lower pressure rating for higher reliability.

5. The manifold space can be large enough for a high pressure gas manifold to split the gas flow to a reinjection header and to a gas sales riser.

6. The space on the turret is sufficient for large pig launcher/receivers for instrumented pigs.

7. Space on the turret is provided for storing quantities of chemical injection fluids and pumps. This feature reduces the number of high pressure fluid paths in the swivel stack for the chemicals.

BRIEF DESCRIPTION OF THE DRAWINGS

The objects, advantages, and features of the invention will become more apparent by reference to the drawings that are appended hereto and wherein like numerals indicate like parts and wherein illustrative embodiments are shown, of which:

FIG. 6A illustrates greatly exaggerated flexure of the turret frame of FIG. 5 when acted upon by horizontal forces on the chain table;

FIG. 6B illustrates greatly exaggerated flexure of the turret frame of FIG. 5 when acted upon by vertical forces on the chain table;

FIG. 7A is a sketch of a turret moored vessel showing a greatly exaggerated example of the vessel in a "sagging" condition with a flexible turret main deck conforming to the shape of the vessel sag;

FIG. 7B is an exaggerated sketch of the turret of FIG. 7A with a flexible main deck;

FIG. 7C is a perspective view of a large diameter turret with a flexible turret having a main deck capable of conforming to a sagging or a hogging shape of a supporting surface subject to vessel sag or hog;

FIG. 13A illustrates a preferred embodiment wherein the riser tube hangs from the main deck of the turret frame;

FIG. 19 shows another embodiment of the invention and shows in an elevation view riser tubes also serving as the structural members connecting the chain table to the turret main deck.

DESCRIPTION OF THE INVENTION

The illustrations of the preferred embodiments of the invention are described by reference to the Figures briefly described above and include reference numbers for the following items:

| | |
|---|---|
| 100 | Flexible frame turret |
| 1 | Turret main deck |
| 2 | Column |
| 3 | Chain table |
| 4 | Bearing Foundation |
| 5 | Turret insert tube (Moonpool) |
| 6 | Pump deck |
| 7 | Manifolds |
| 8 | Winch deck |
| 9 | Winch |
| 10 | Swivel stack |
| 11 | Swivel torque tube |
| 12 | Load wheels |
| 13 | Radial wheels |
| 14 | Uplift wheels |
| 15 | Radial spring assembly |
| 16 | Riser tube |
| 17 | Riser bend stiffener |
| 18 | Riser |
| 19 | Chain support |
| 20 | Mooring chain |
| 21 | Winch line |
| 22 | Piping |
| 23 | Safety valves |
| 24 | Riser support clamp |
| 25 | Riser tube slip joint |
| 26 | Rail |
| 27 | T-Beam |
| 28 | Horizontal sheave |
| 29 | Moveable vertical sheave |
| 30 | Vessel main deck |
| 31 | Radial beam |
| 32 | Center ring |
| 33 | Riser support tube |
| 34 | Outer ring |
| 35 | Chemical tank |
| 36 | Chemical pump unit |
| 37 | Seal |
| 38 | Elastomeric bumper pad |
| 39 | Clearance gap |
| 40 | Chain installation deck |
| 41 | Chain hang-off bracket |
| 42 | Lower bearing |
| 43 | Vessel hull structure |
| 44 | Riser tube flange |
| 45 | Hanging riser tube |
| 46 | Welding fixture |
| 47 | Weld joint |
| 48 | Riser tube collar |
| 49 | Riser end fitting |
| 50 | Riser tube hole |
| 51 | Hull elastic curve |
| 52 | Main deck elastic curve |
| 53 | Central column |

Figure 2:
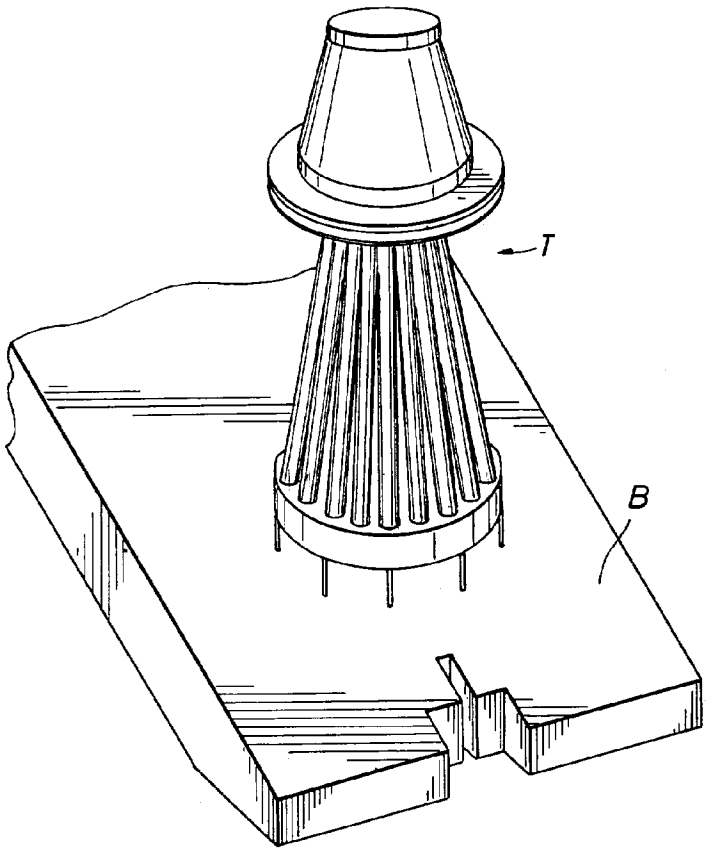
FIG. 2 (PRIOR ART)
FIGS. 2, 3 and 4 depict prior art turrets and turret moored vessels as described above.
Figure 1:
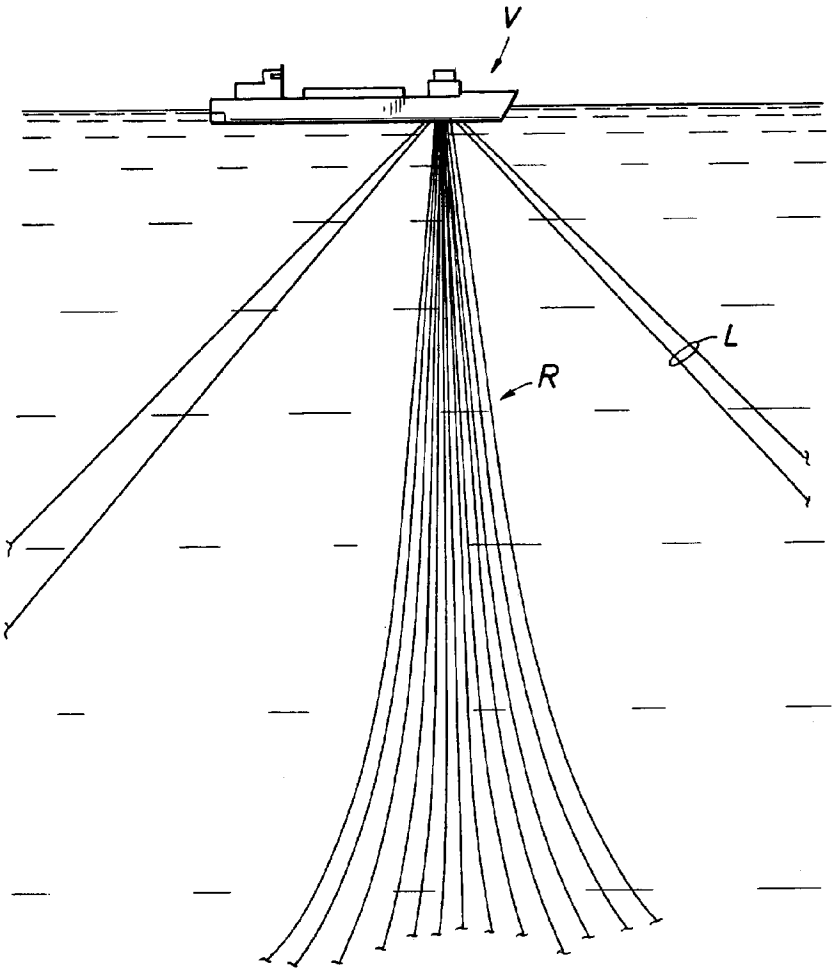
FIG. 1 (PRIOR ART)
FIG. 1 is an illustration of a prior art FPSO vessel floating on the sea with anchor legs connected between a seafloor and a rotatably mounted turret on the vessel, with numerous flowlines on the seafloor coupled to and flexible risers supported from the turret in the floating vessel.
Figure 3:
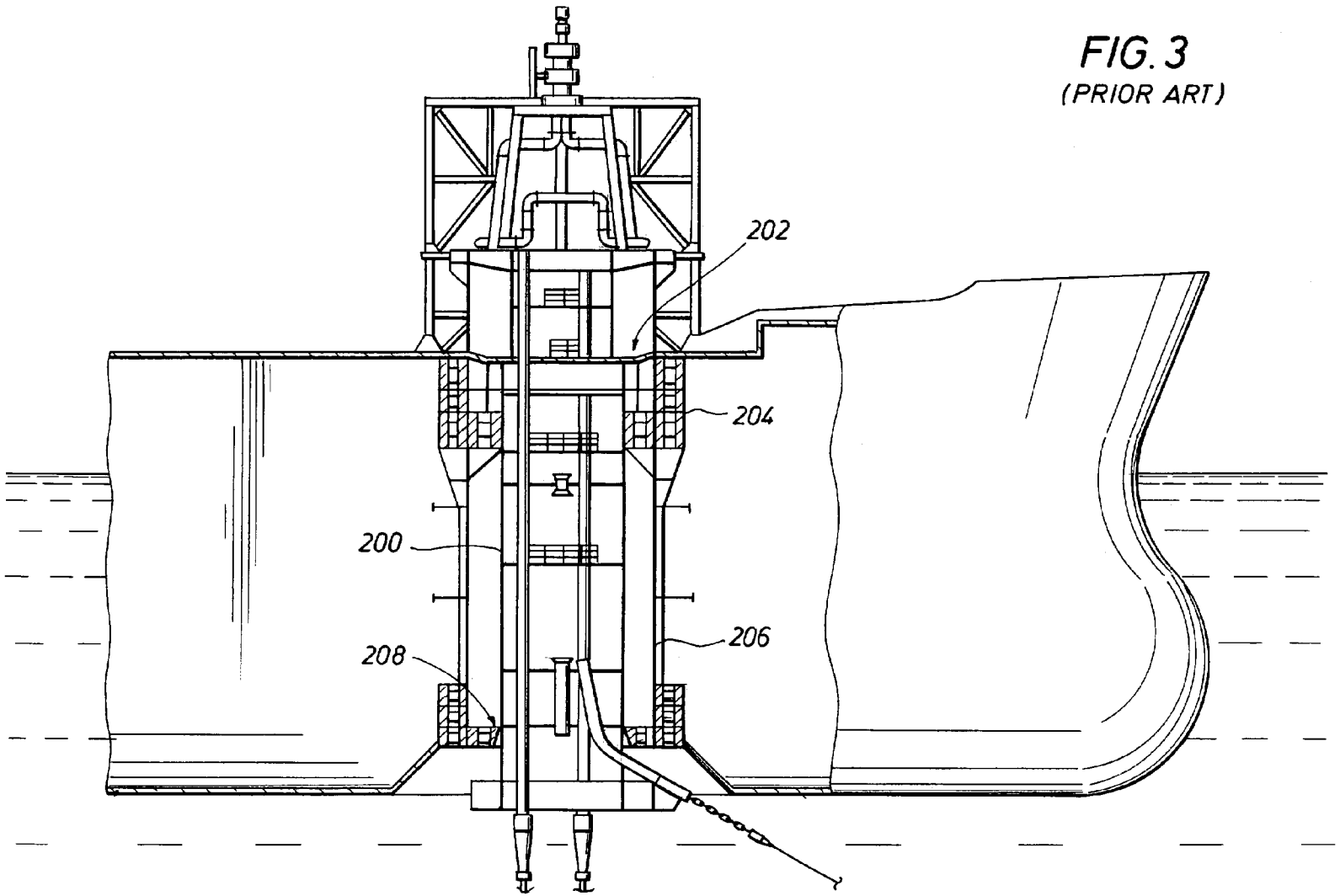
FIG. 3 (PRIOR ART)
Figure 4:
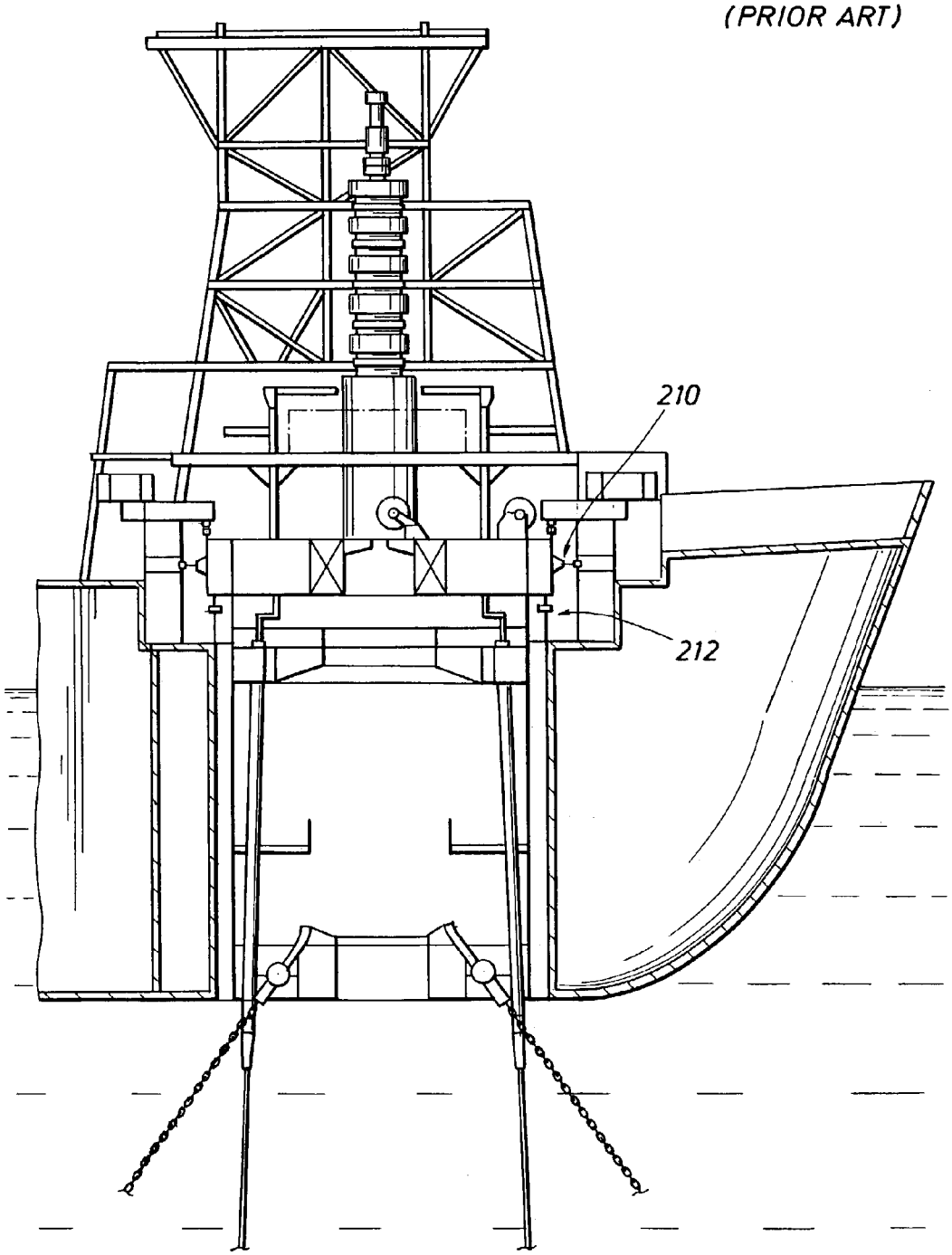
FIG. 4 (PRIOR ART)

FIG. 1 illustrates a prior art FPSO V floating on the sea with anchor legs L and numerous flexible risers (i.e., flexible marine hoses) R hanging from the turret to the seafloor. Other known variations of riser systems including steel catenary and hybrid steel and flexible riser systems are suitable for the turret of this invention.

Figure 5:
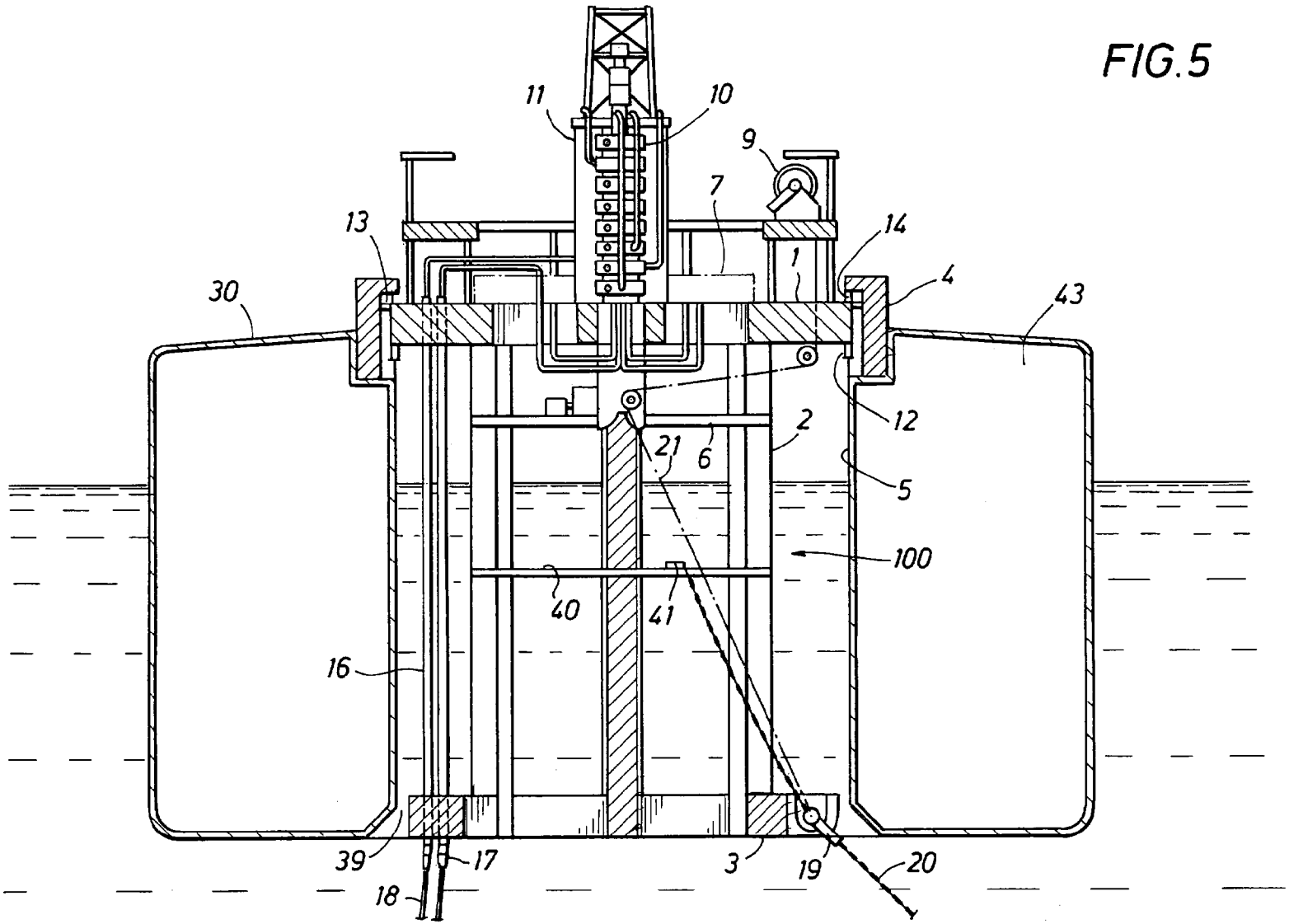
FIG. 5 illustrates an embodiment of the invention in a transverse cross sectional view of a turret in a vessel, and shows an upper bearing located near the main deck of the vessel, but does not include a lower bearing near the vessel keel.

FIG. 5 is a transverse sectional view of one preferred embodiment of the invention. The flexible frame turret 100 comprises three primary components: turret main deck 1; connecting structure such as columns 2; and chain table 3. At least three pillars or columns 2, but preferably six, connect main deck 1 to chain deck 3 with structural moment connections that transfer the axial forces and moments from chain table 3 to main deck 1. A single pillar or cylindrical structure could be substituted for pillars or columns 2 between deck 1 and chain table 3. (See FIG. 20) Mooring chain 20 is the upper section of the mooring leg; it is attached to chain table 3 by a pivoting ratchet type chain support 19. A radial array including at least three mooring legs, but preferably a total of nine legs in three groups of three legs each, is commonly used where each leg comprises various known combinations of chain, wire rope, synthetic or polyester rope, all connected together with suitable shackles and fittings to a termination point on the seafloor at anchors or piles. Chain installation deck 40 provides access to workers to handle chain during mooring leg installation. The slack end of chain 20 is secured to deck 40 by chain hang-off bracket 41 after winch 9 pulls mooring leg 20 to an appropriate tension.

Risers 18 extend from the sea floor beneath the flexible frame turret 100 and extend through chain table 3 and through riser tubes 16 to main deck 1. A riser bend stiffener 17 restrains each riser 18 horizontally and transfers horizontal forces of the risers to the chain table 3. The riser tubes 16 protectively enclose each riser 18 from chain table 3 to main deck 1.

When environmental forces cause the vessel to move from its neutral calm water position, vertical and horizontal mooring restoring forces of anchor legs 20 act on chain table 3 and are transferred through pillars or columns 2 (or other suitable structure) to main turret deck 1, and through three sets of wheels 12, 13, 14, into bearing support 4, as shown below by reference to FIGS. 12 and 13. Turret insert tube 5 is a primary load transfer structure attached inside the vessel hull structure 43. Subsea currents, surface wave motions, and vessel offset motions also cause vertical and horizontal riser forces to act on the turret. Riser forces are significant because of the great number of risers provided. As few as 40 and up to as many as 120 risers 18 are contemplated for use with the preferred embodiment of the invention. Vertical riser forces of risers 18 are transferred upward through each riser tube 16 and are primarily reacted by turret main deck 1. Horizontal riser forces are transferred horizontally at chain table 3 and are primarily reacted by chain table 3.

FIG. 6A illustrates the flexible nature of the turret frame 100 with horizontal forces represented by arrow $F_x$ applied to chain table 3. The cumulative horizontal forces of the risers and anchor legs are represented by a single vector $F_x$. The deflected frame shape of chain table 3, pillars or columns 2 and turret main deck 1 is exaggerated in the drawing for clarity. Horizontal force "$F_x$" causes chain table 3 to deflect horizontally a distance "$X_1$" until the internal forces and moments in the frame 100 reach equilibrium. Clearance gap 39 provides sufficient space for horizontal elastic deflections of chain table 3. The entire turret frame 100 including main deck 1, pillars or columns 2 (or other suitable connecting structure such as a small diameter tube), and chain table 3, contribute to the total flexibility. All of the pillars or columns 2 bend elastically while being partially constrained by their direct connection to main deck 1 and chain table 3.

FIG. 6B illustrates the flexible nature of the turret frame when downward vertical loads "$F_z$" and "$F_r$" act on chain table 3. The cumulative downward force of the anchor legs is represented by the vector $F_z$. The cumulative vector "$F_z$" is applied to chain table 3 through the connection of mooring chain 20 and chain support 19. (See FIG. 5). Force "$F_z$" does not necessarily act at the geometric center of the turret, a condition that causes non-symmetrical deflection of the frame that is not illustrated. Force "$F_z$" is transferred from chain table 3 through pillars or columns 2 to turret main deck 1. Force vector "Fr" represents the downward force exerted by each riser 18 through riser tube 16 onto main deck 1. Each riser force vector "Fr" may have a different numerical value resulting in a non-uniform distribution of load onto main deck 1. The deflected frame shape resulting from "$F_z$" and "Fr" is exaggerated in FIG. 6B for clarity. Pillars or columns 2 bend elastically in a different curve from that illustrated in FIG. 6A.

FIG. 7A is a greatly exaggerated sketch of a vessel hull in which an internal turret 100 of the invention is installed and rotatably supported within a moonpool of the hull. The FIG. 7A sketch shows the vessel bent into a so-called "sagging" condition such that a hull elastic curve 51 is characterized by a radius of curvature $R_1$, which is many times greater than $C_1$, the distance from elastic curve 51 to the vessel main deck 30. From elementary beam theory it is known that the elastic curve passes through the horizontal neutral axis of each cross section of a beam in bending, in this case, the vessel hull.

Figure 12:
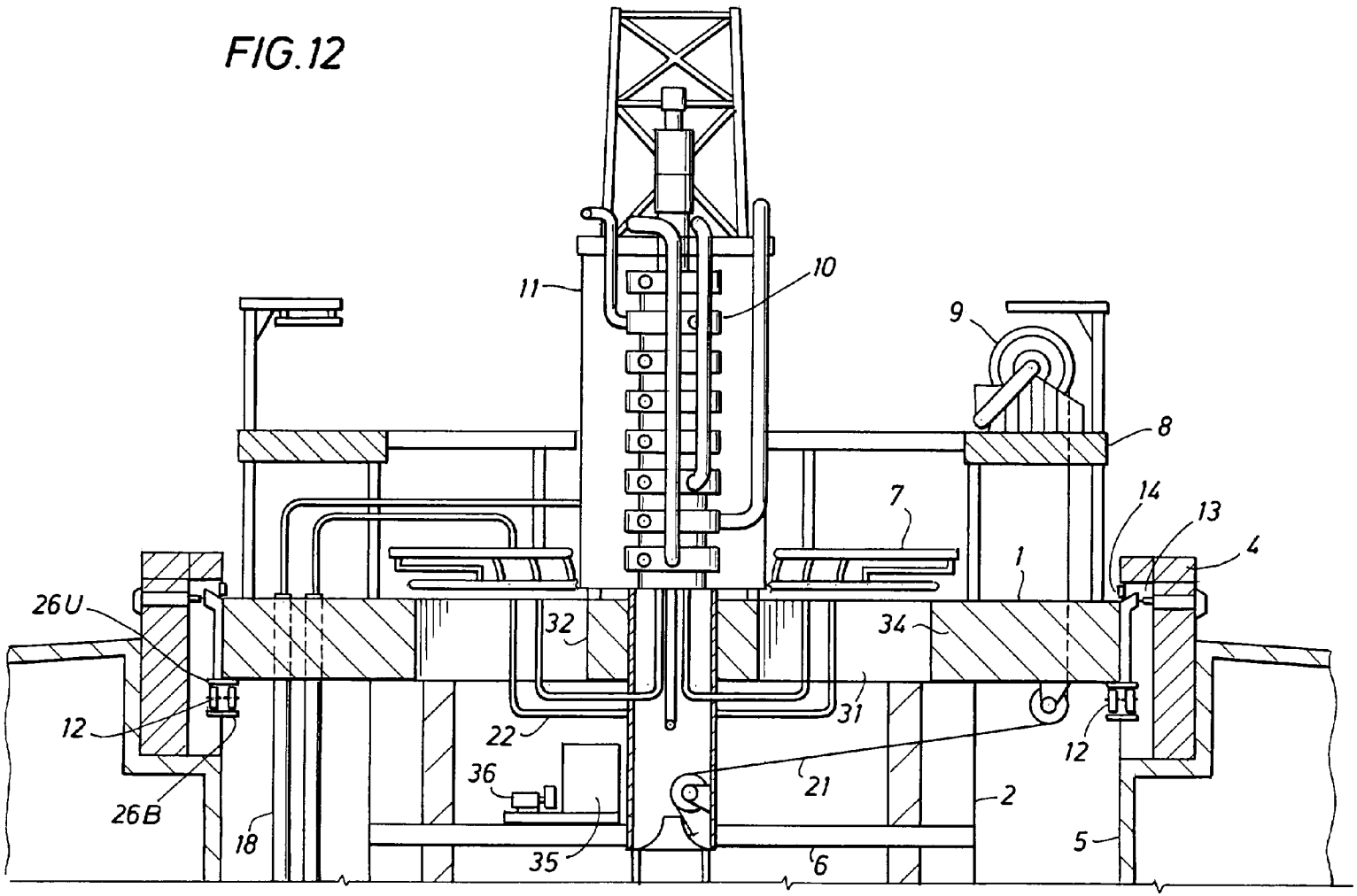
FIG. 12 is an enlarged view of the upper turret structure of the arrangement illustrated in FIG. 5, showing the bearing system and related apparatus.
Figure 13:
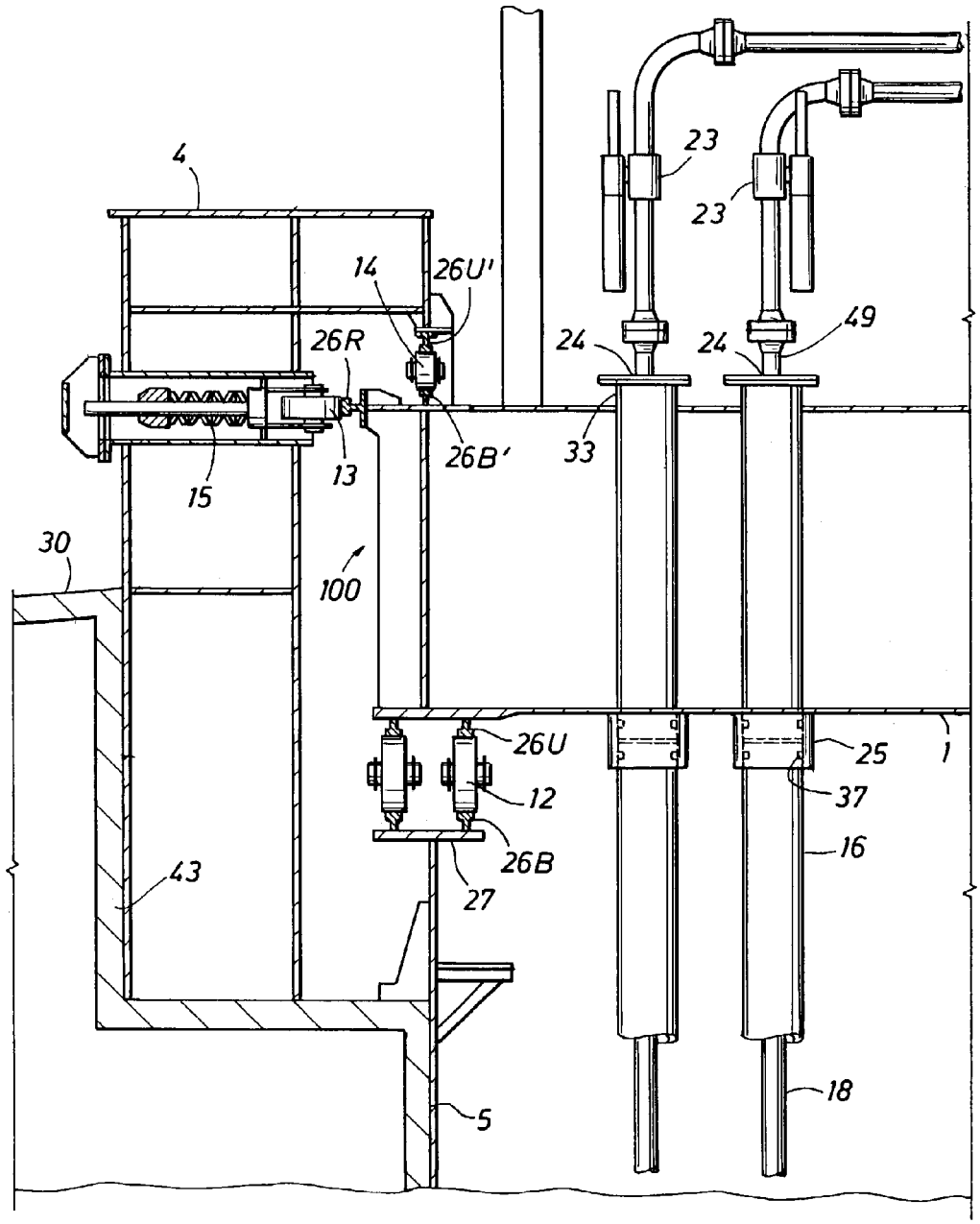
FIG. 13 is an enlarged cross section view of the arrangement illustrated in FIG. 5 showing the area at one side of the turret at the bearing and riser supports.
Figure 13B:
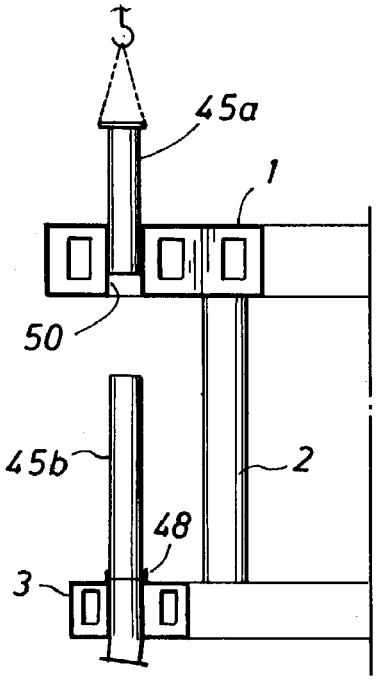
FIGS. 13B, 13C, 13D and 13E illustrate the construction assembly of riser tubes for a preferred embodiment of this invention.

FIGS. 7B, 12, and 13 illustrate wheels 12 mounted between upper and lower rails 26U, 26B. The lower rail 26B is mounted on the turret insert tube 5 or "moonpool" of the vessel. The upper rail 26U is mounted on a surface of the turret main deck and is positioned concentrically with bottom rail 26B. FIG. 7B shows the turret 100 with an exaggerated sketch illustrating the flex of the turret 100. As shown in FIGS. 7A and 7B, the arrow $R_2$ represents a radius of curvature of the turret main deck elastic curve 52 of turret main deck 1, while the arrow $R_3$ represents a radius of curvature of the bottom surface of the turret main deck 1. Since the radii $R_1$, $R_2$, and $R_3$ are very large, and the radii of curvature depicted in FIG. 7A all are much greater than the distance $C_1$, then a common radius of curvature can be assumed for $R_1$, $R_2$, and $R_3$. That is, $$R_1 >> C_1, \text{ and}$$

$$R_1 \approx R_2 \approx R_3 = R.$$

The hull bending stress $\sigma_h$ can be represented approximately as:

$$\sigma_h = E\left(\frac{C_1}{R}\right)$$

where $E$ is Youngs Modulus $= \frac{\text{Stress}}{\text{Strain}}$, for the structural material, and predicts the elongation or compression of an object as long as the stress is less than the yield strength of the material.

In FIG. 7B, the thickness $h_3$ of the turret main deck 1 results in a distance $C_2$ from the top plate of main deck 1 to elastic curve 52. The radius of curvature $R_2$, which can be represented by a common radius R as indicated above, results in a turret main deck bending stress $\sigma_t$, $$\sigma_t = E\left(\frac{C_2}{R}\right) \text{ and } \sigma_t = \sigma_h\left(\frac{C_2}{C_1}\right).$$

It can be seen that the hull bending stress $\sigma_h$ is greater than turret main deck bending stress $\sigma_t$ due to hogging and sagging.

The bottom rail 26B elastically deflects approximately in the shape of vessel main deck 30. See FIG. 13 for an enlarged view of rail 26B. The turret 100 of a preferred embodiment this invention, as illustrated in FIG. 7B, is designed to have a flexibility so that main deck 1 conforms to follows the bend of the vessel when the vessel sags (or hogs . . . the opposite of sag) so load wheels 12 remain in contact with rail 26B, thereby continuing to distribute the vertical load to all of the wheels 12. The total deflection of the turret main frame 1 can be determined, because each of the deflections of the turret frame 100 described by reference to FIG. 6A (deflection due to horizontal forces $F_x$), FIG. 6B (deflection due to vertical loads) and FIGS. 7A and 7B (deflection due to hogging or sagging) are linear and can be added by the principle of superposition.

FIG. 7C illustrates a preferred design or embodiment of the invention where the turret 100 includes a chain table 3 with pillars 2 connecting a turret main deck 1 of thickness $h_3$ and with the main turret deck 1 having a central hub 32 and spokes 31 connecting an outer ring 34. The hub, spoke, outer ring design of the turret main deck 1, combined with its thickness $h_3$ allows sufficient flexibility for upper rail 26U to flex in conformity with the sagging shape of bottom rail 26B when the vessel sags. The main deck 1 flexes due to the vertical force acting on it as illustrated in FIG. 6B.

Figure 8:
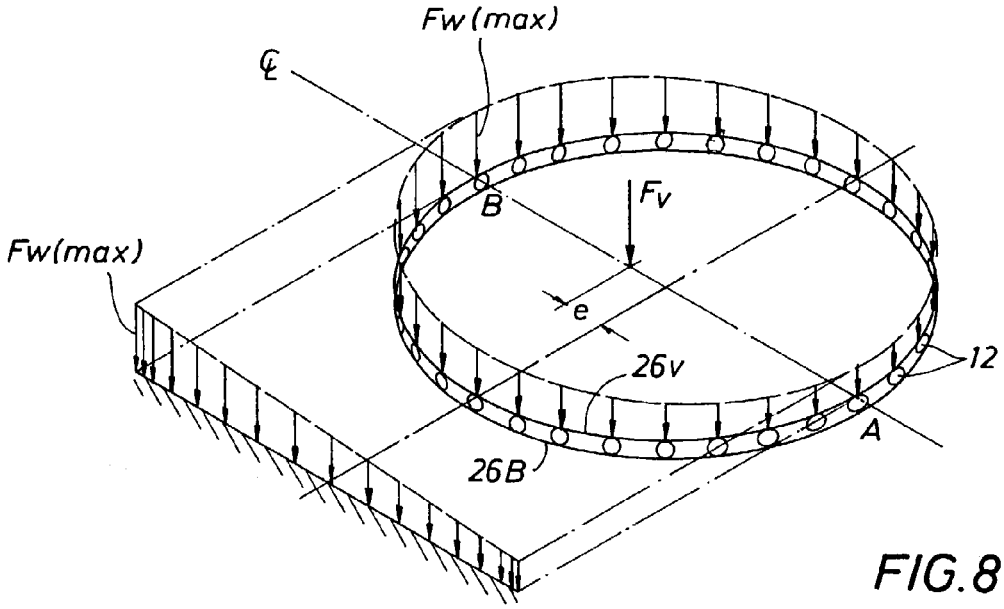
FIG. 8 is a sketch which illustrates wheel loads distributed around a circular roller track (rail), with a linear load variation that occurs when an upper rail of the turret and a bottom rail of the vessel are both in a perfectly flat condition and an external load "Fv" is acting vertically at an eccentric location "e" from the center of the bearing.

FIG. 8 is a diagram of wheel loads distributed around a circular track between upper rails 26U and bottom rails 26B with a linear load variation that occurs with the rails 26U and 26B in a perfectly flat condition and an external load "Fv" acting vertically at an eccentric location "e" from the center of the rails of the bearing. On side "B" of the bearing, the wheel load is a maximum of "Fw(max)" per wheel on one or two wheels, while all other wheel loads are smaller. At side "A" the load per wheel reaches the minimum value. The wheel load is linearly distributed along the centerline (C/L) of the vessel from point A to point B.

Figure 9:
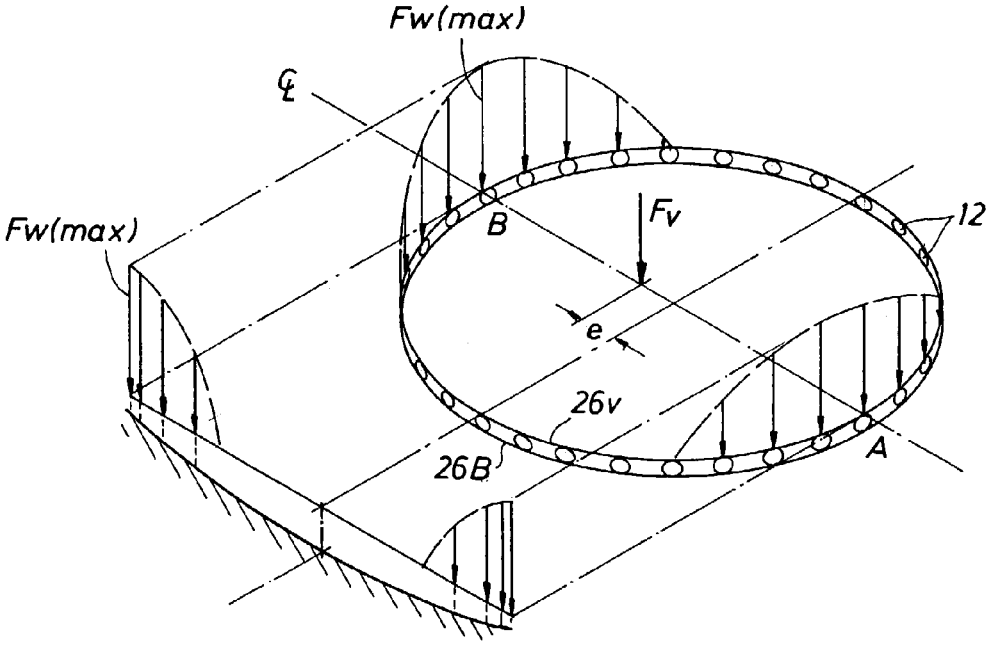
FIG. 9 illustrates wheel loads distributed around a circular roller track (rail) that has been deformed by bending deflection of the vessel hull, and shows that the upper rail attached to a stiff turret does not conform to the shape of the roller track on the vessel hull.

The diagram of FIG. 9 shows wheel loads distributed around a circular track where the lower rail 26B has been displaced, but the upper track rail 26U is attached to a very rigid turret structure that is in a flat plane. The lower track rail 26B has been deflected out of the flat plane into an exaggerated "sagging" deflection curve. This condition causes the maximum load per wheel 12 to reach higher values at locations "A" and "B" than occurs with both rails 26U, 26B in a flat plane, as illustrated in FIG. 8. Some of the wheel loads are reduced to near zero, or some wheels may even lift off of the track, while the maximum wheel load can reach two to five times the "Fw(max)" load per wheel shown in the FIG. 8 flat rail condition. An eccentric load as shown in FIG. 9 again causes the maximum load per wheel to occur near location "B".

Figure 10:
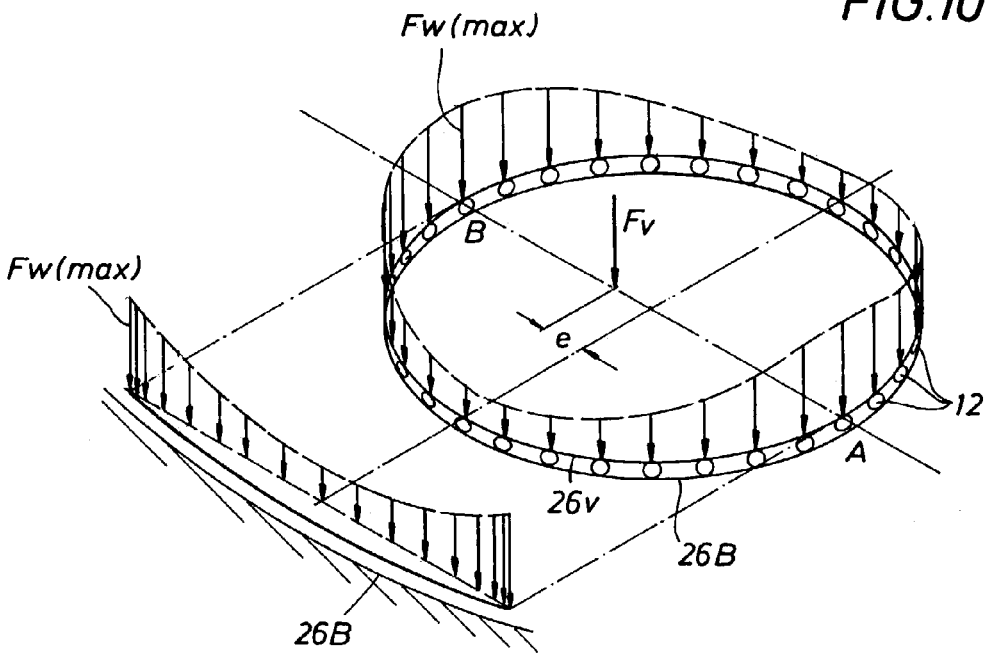
FIG. 10 illustrates wheel loads distributed around circular track rails that have been deflected by vessel hull bending and shows that where the turret structure above the upper rail is sufficiently flexible, the upper rail conforms to the out-of-plane shape of the lower rail.

FIG. 10 demonstrates wheel loads distributed around circular track rails 26U, 26B that have been deflected by vessel hull bending. The lower rail 26B attached to the vessel structure is deflected because of vessel "sagging". In this case the turret structure 100 (See FIGS. 12, 13) is sufficiently flexible so that the upper rail 26U tends to conform to the out-of-plane shape of the lower rail 26B due to the downward vertical force Fv, thereby more uniformly distributing the total load to all of the wheels 12. This improved distribution reduces the maximum load per wheel to a significantly lower value than is the case for the conditions of FIG. 9. When the load is eccentric by an amount "e", the maximum load per wheel again occurs at location "B."

Figure 11:
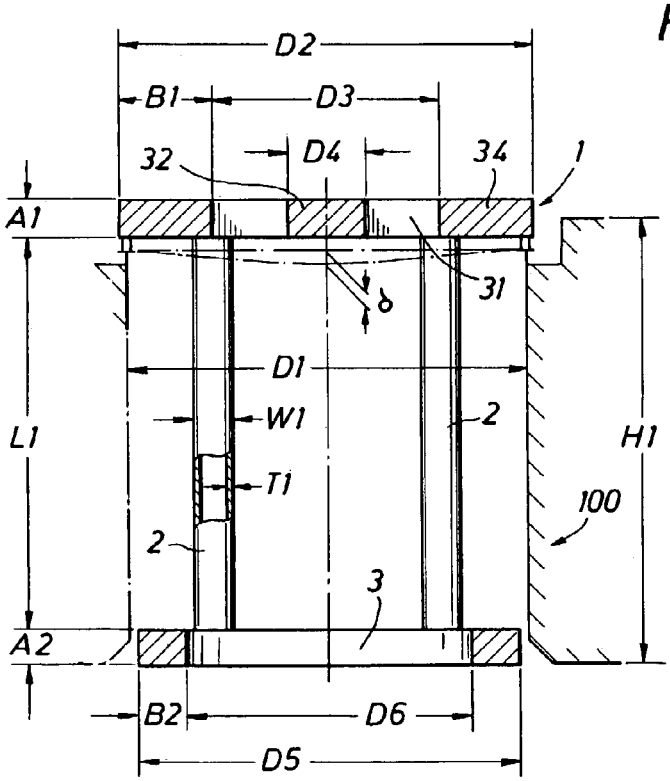
FIG. 11 illustrates the basic geometry of the flexible turret frame of a preferred embodiment of the invention and defines certain dimensions used as parameters for turret design.

FIG. 11 and Table 1 below illustrate geometric proportions of the turret frame 100 that are provided to assure sufficient frame flexibility according to a preferred embodiment of the invention.

TABLE 1

| Dimension Ratio | Minimum Ratio | Maximum Ratio |
|---|---|---|
| D2/D1 | 1.00 | 1.30 |
| D3/D1 | 0.40 | 0.70 |
| D4/D1 | 0.15 | 0.25 |
| D5/D1 | 0.70 | 1.20 |
| D6/D5 | 0.60 | 0.80 |
| A1/D1 | 0.05 | 0.15 |
| A2/D5 | 0.05 | 0.15 |
| L1/D1 | 0.70 | 2.00 |
| W1/L1 | 0.06 | 0.15 |
| T1/W1 | 0.01 | 0.03 |
| δ/D1 | 0.0000 | ±0.0010 |

The turret deflections at rail 26U can be defined by a parameter d, a measurement of deviation of the elastic curve from a flat plane at the support rail 26U as illustrated in FIG. 11. Hull deflections can typically cause a δ in lower rail 26B of about 15 millimeters with a moonpool diameter D1 of twenty-nine meters. The expected range of upper rail 26U deflections as a basis for this invention is a δ/D1 ratio ranging from zero to 0.0010, where D1 is the central diameter of the support wheel rails 26U and 26B.

Figure 11A:
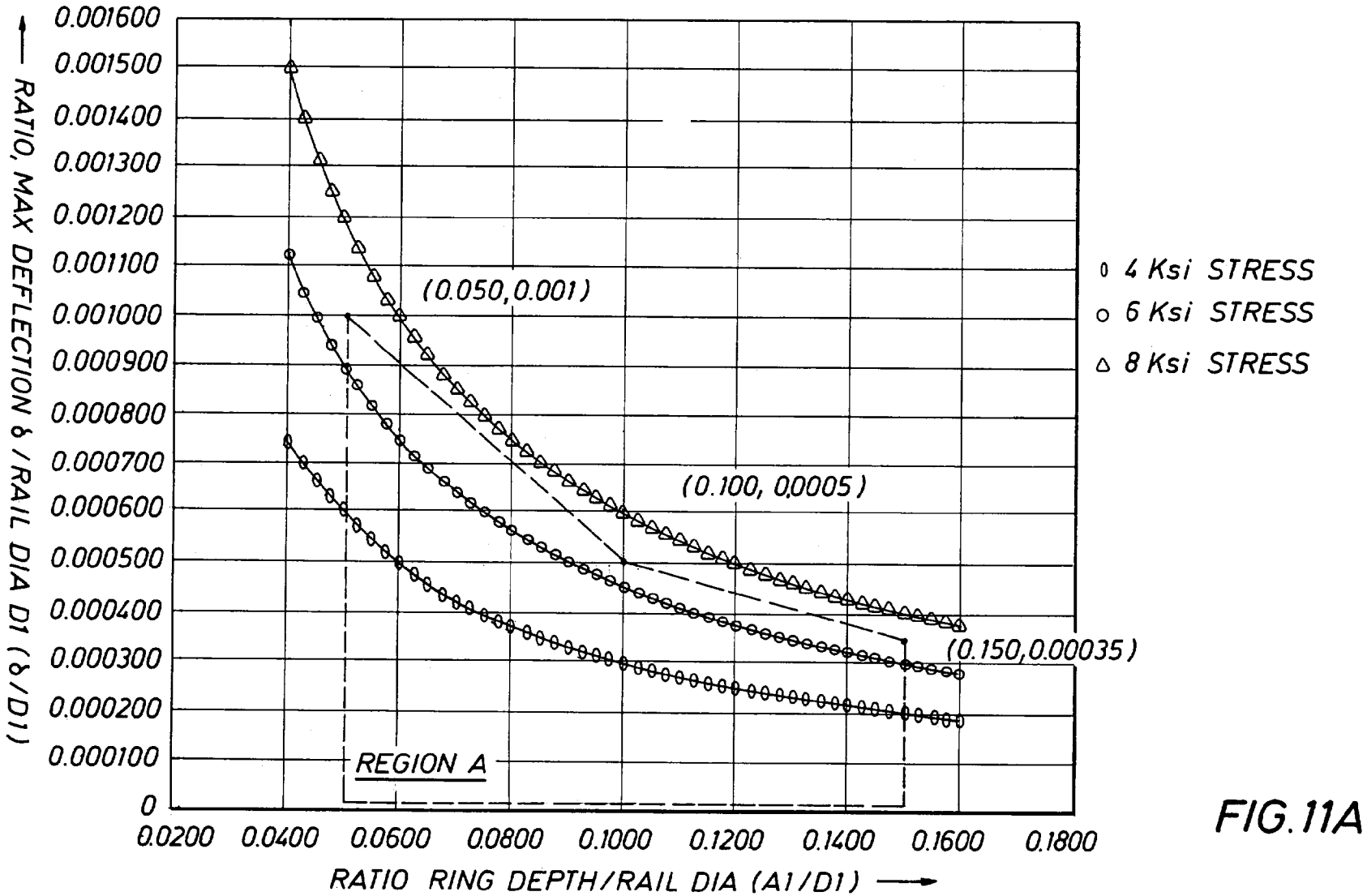
FIG. 11A is a graph of the parameter $\delta/D1$ as a function of a ratio A1/D1 with an indication of acceptable ranges of those parameters to achieve a sufficiently flexible turret in order to meet specified characteristics.

FIG. 11A provides graphs that define the allowable dimensional ratios, deflection ratios, and characteristic stress, for the flexible frame 100 of FIGS. 11 and 7C. Characteristic stress is a numerical value based upon the nominal bending stress occurring in the turret main deck 1 outer ring 34. A specific range of ratio of depth-of-turret-main-deck A1 to support-rail-diameter, D1, A1/D1, is required to more uniformly distribute loads to the wheels 12 while assuring that stress is not large enough to cause metal fatigue failure in the turret main deck 1. Region A in FIG. 11A is the desired range of turret main deck 1 proportions A1/D1 as a function of deflection ratio δ/D1 for the preferred embodiment of turret 100. To achieve the objective distribution of load for the wheels 12, a preferred design requires that the turret frame proportions be dimensioned to allow turret main deck 1 deflections that maintain at least 90% of the load wheels 12 in contact with their rails 26B, 26U while only a fraction of the total maximum vertical load is applied to any one wheel for the turret main deck 1.

FIG. 12 is an enlarged view of the upper turret structure of the arrangement illustrated in FIGS. 5 and 7C, with its bearing system, and equipment near turret main deck 1. Main deck 1 includes outer ring 34 and center ring 32 connected together by radial beams 31. Pump deck 6 is positioned below main deck 1 and is supported by pillars 2. Pump deck 6 supports chemical tank 35 and chemical pump unit 36. An assortment of ancillary modular equipment related to the fluids transfer system and control system can be located on deck 6.

Components of the fluid transfer system that are supported by main deck 1 include manifold 7, fluid swivel stack 10, and flexibly supported piping 22. Winch deck 8 has a support frame which is mounted on outer ring 34 of main deck 1 that allows main deck flexure without excessive stresses in the supports. In other words, the mounting of deck 8 on outer ring 34 is done so as not to stiffen outer ring 34 or the entire turret 100. FIG. 12 shows reeving of winch wire 21 from winch 9 to a centrally mounted rope sheave mounted on deck 6 for the purpose of pulling in a mooring leg. Winch wire 21 is reeved differently to pull in risers 18 using winch 9.

FIG. 13 is an enlarged cross section view of the arrangement illustrated in FIG. 5 showing the area at one side of the turret 100 at the bearing and riser supports. All loads from the turret 100 acting on the vessel 30 are transferred through load wheels 12, radial wheels 13, and uplift wheels 14. Rollers 12, 13, and 14 roll on rails 26 as illustrated in FIG. 13. Vertically acting loads are transferred through dual concentric rails 26U, 26B to turret insert tube 5 and hull structure 43 by means of the load equalizing effect of T-beam 27. Radially acting loads are transferred to vessel hull structure 43 by means of radial wheels 13 held against radial rail 26R by means of radial spring assemblies 15. The action of spring assemblies 15 serves to distribute radial load to radial wheels 13 when bearing foundation 4 is deflected out of its initial circular shape by hull deflections. Uplift wheels 14 provide restraint of the turret against rails 26B' and 26U' in an unusual event that could cause uplift of main deck 1.

FIGS. 13 and 5 also show that the riser tube 16 is positioned between main deck 1 and chain table 3 and is vertically supported by chain table 3. A riser tube 16 encloses each riser 18 and provides protection of each riser 18 from accidental physical impact from moving objects and from accidental fire and explosion. Heat insulation material for fire protection can be applied to each riser tube 16 and to each pillar 2. Riser tube slip joint 25 (FIG. 13) horizontally restrains riser tube 16 while allowing small vertical displacements of guide tube 16 relative to main deck 1. Seals 37 prevent leakage at the joint to the atmosphere of any accumulated gas from the interior of riser tube 16. The weight of riser 18 is supported by means of riser support tube 33, and riser support clamp 24 fitted onto riser end fitting 49. This arrangement of riser tube support does not appreciable increase overall stiffness of the turret frame. Piping connections to the risers include safety valves 23.

FIG. 13A illustrates an alternative embodiment of riser tube 18 coupling to turret 100 wherein a hanging riser tube 45 is connected to turret main deck 1. This feature is advantageous because it eliminates the need for chain table 3 to carry the weight of riser tubes 16 as shown in FIGS. 13 and 5. The weight of forty to one hundred twenty riser tubes can be in the range of several hundred to thousands to metric tonnes. Riser tube collar 48 is fastened to chain table 3. Hanging riser tube 45 is a slip fit inside riser tube collar 48, and end clearance is provided at the bottom end of riser tube 45 to allow small relative displacements of the riser tube 45 relative to chain table 3. Riser tube 45 is arranged and designed so that it can flex without being overstressed at its connection to turret main deck 1. Riser tube flange 44 of riser tube 45 is supported on deck 1, and riser support clamp 24 is mounted on flange 44.

Figure 13C:
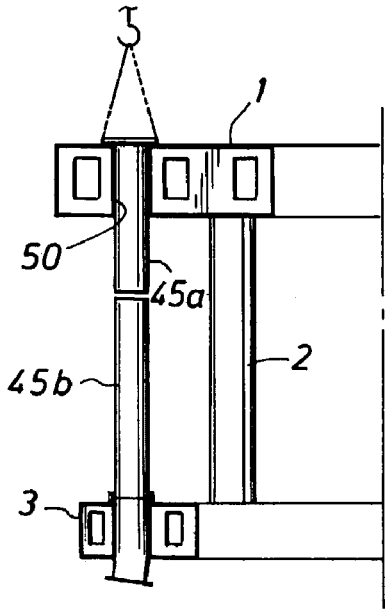
Figure 13D:
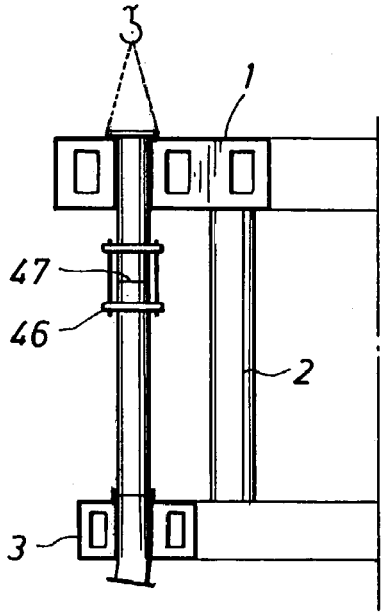
Figure 13E:
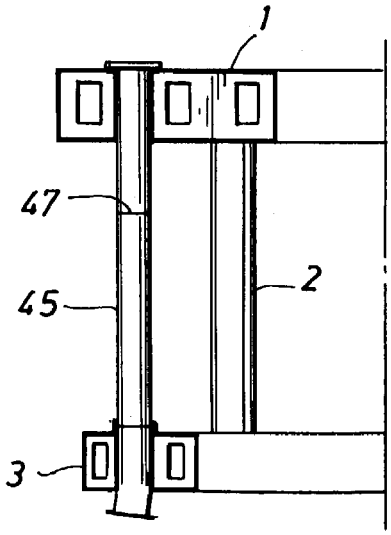

FIGS. 13B, 13C, 13D, and 13E, illustrate a preferred installation method for hanging riser tubes 45 into main deck 1. If sufficient crane boom height is not available, riser tube 45 can be fabricated as one piece and lowered into the slip fit of collar 48 on chain table 3 and into its place resting on main deck 1 as in FIG. 13A. If insufficient crane boom height is available for one-piece installation, the riser tube can be installed in two or more pieces wherein a first riser tube section 45*b* is lowered through tube hole 50 to rest on chain table 3 as in FIG. 13B. Subsequently, riser tube 45*a* is lowered through hole 50 to rest on main deck 1 as shown in FIG. 13C. In FIG. 13D, welding fixture 46 is used to clamp tube sections 45*a* and 45*b* together in alignment for making weld joint 47. FIG. 13E illustrates the completed riser tube 45.

Figure 14:
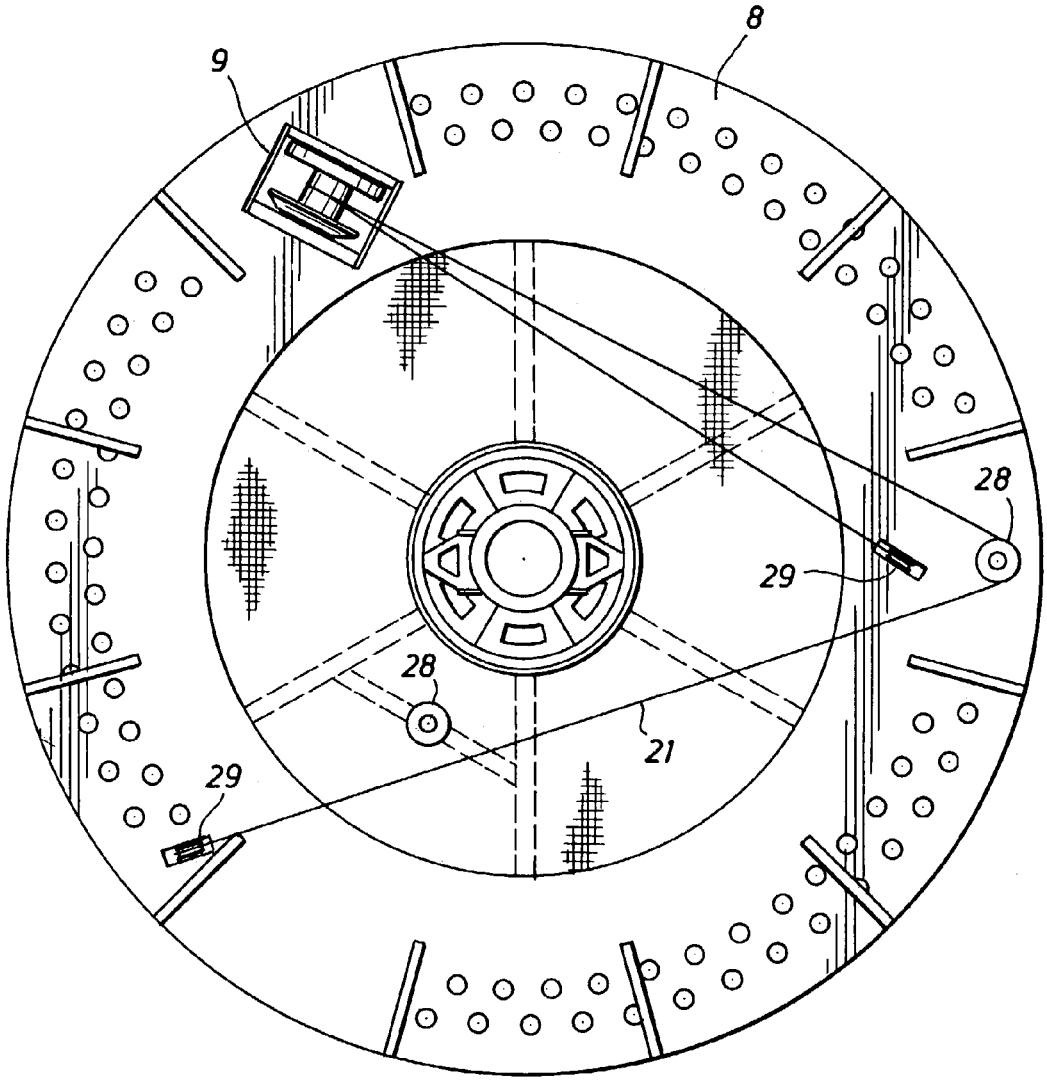
FIG. 14 shows an embodiment of the invention with a top plan view of the turret winch deck of the arrangement illustrated in FIG. 5.

FIG. 14 illustrates winch deck 8 in a plan view (see also FIGS. 5 and 12) where winch 9 is used to pull in all risers and anchor legs. A horizontal sheave 28, and at least one moveable vertical sheave 29, provide an arrangement for reeving winch line 21 to a point above any of risers 18 to provide vertical pull-in the risers. FIG. 5 illustrates the arrangement where winch line 21 is reeved through a central sheave from which any of anchor chains 20 can be pulled in or let out during installation or readjustment of anchor leg tension.

Figure 15:
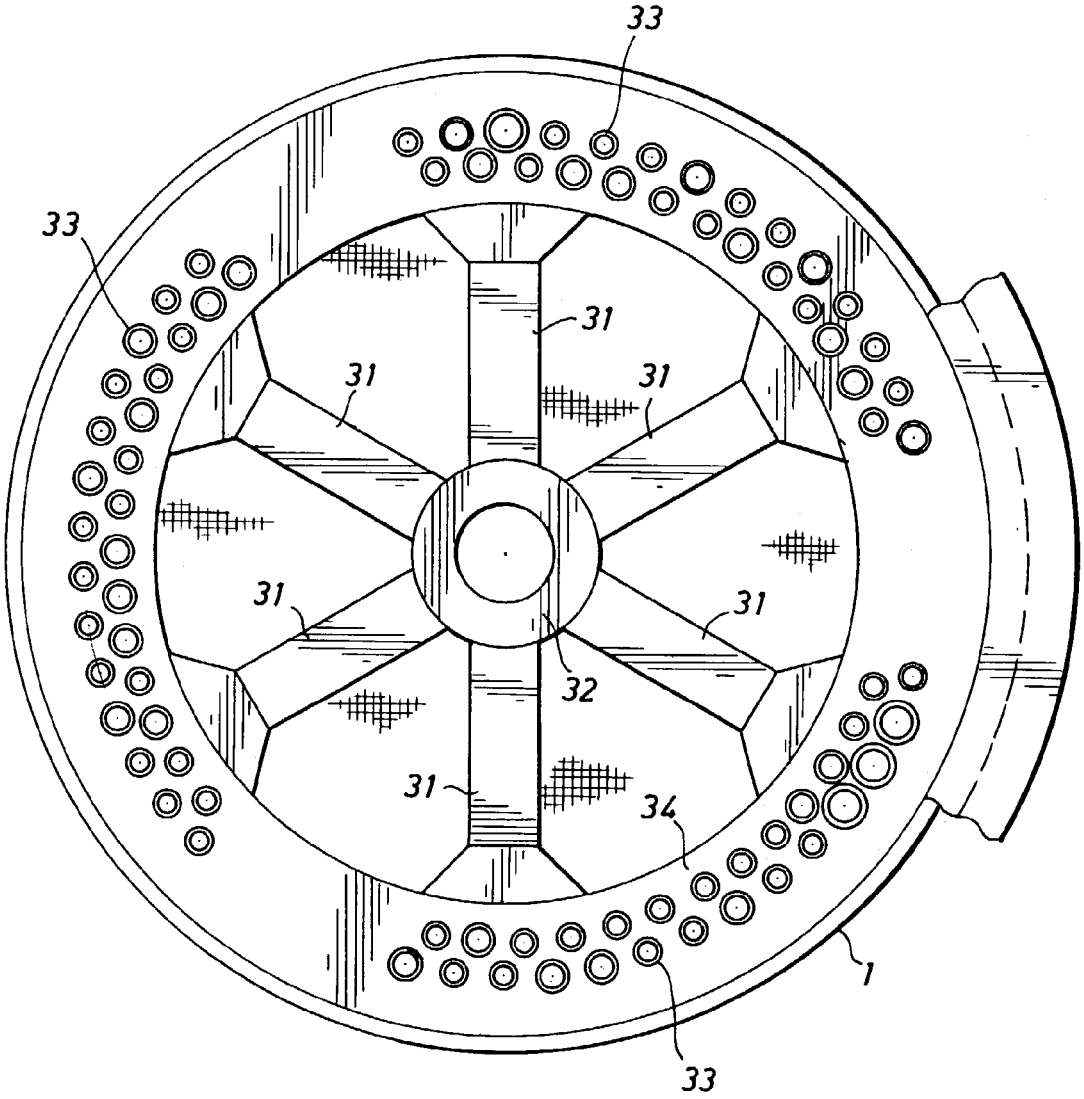
FIG. 15, is a plan view of the turret main deck of the arrangement illustrated in FIG. 5 where manifold piping and equipment are omitted from the view for clarity.

FIG. 15 is a plan view of main deck 1 and illustrates structural components of main deck 1 that provide the required flexibility and strength of the preferred embodiment of turret frame 100 according to the invention. At least three (but preferably six) radial beams 31 connect and support center ring 32 to outer ring 34. As mentioned above, a single cylindrical tube (See FIG. 20) can be substituted for the pillars or columns 2, but its flexibility must be designed in coordination with chain deck 3 and main deck 1. Center ring 32 provides support for swivel stack 10 and its associated piping. Pillars or columns 2 (see FIG. 5) are connected to the underside of radial beam 31 near the intersection of radial beam 31 and outer ring 34. The large open space between radial beams 31 is advantageous for turret interior ventilation and minimizes internal pressure in the moonpool area in the event of a gas explosion.

Figure 16:
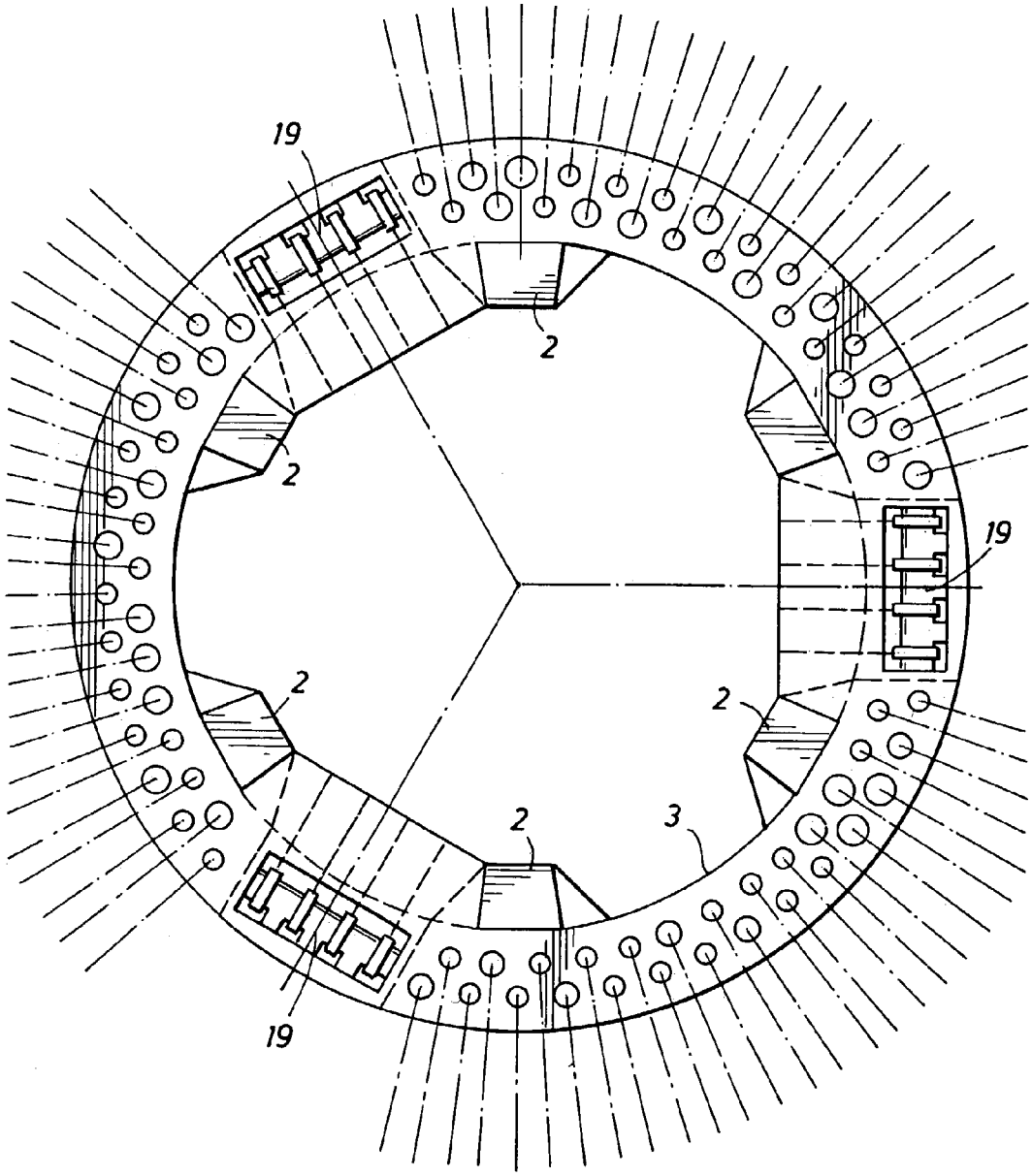
FIG. 16 shows a plan view of the chain table of the arrangement illustrated in FIG. 5.

FIG. 16 is a plan view of chain table 3 and illustrates a preferred embodiment of structural components that provide the required flexibility and strength of the turret frame of this invention. At least three, and preferably six pillars 2 (see also FIG. 5) are attached by moment connection to chain table 3. No brace members are provided between pillars or columns 2 so that a desired flexibility of the turret 100 may be achieved. The pillars 2 are spaced apart to provide clearance for pulling all mooring chains 20 radially toward the center of the turret frame. This arrangement of FIG. 16 also provides open clear space diametrically across the interior of the turret frame, that can advantageously be used for launching underwater remote operated vehicles (ROVs), diver entry into the water at the center of the turret, or space for subsea well service equipment or well work-over equipment to operate out of the bottom of the turret.

Figure 17:
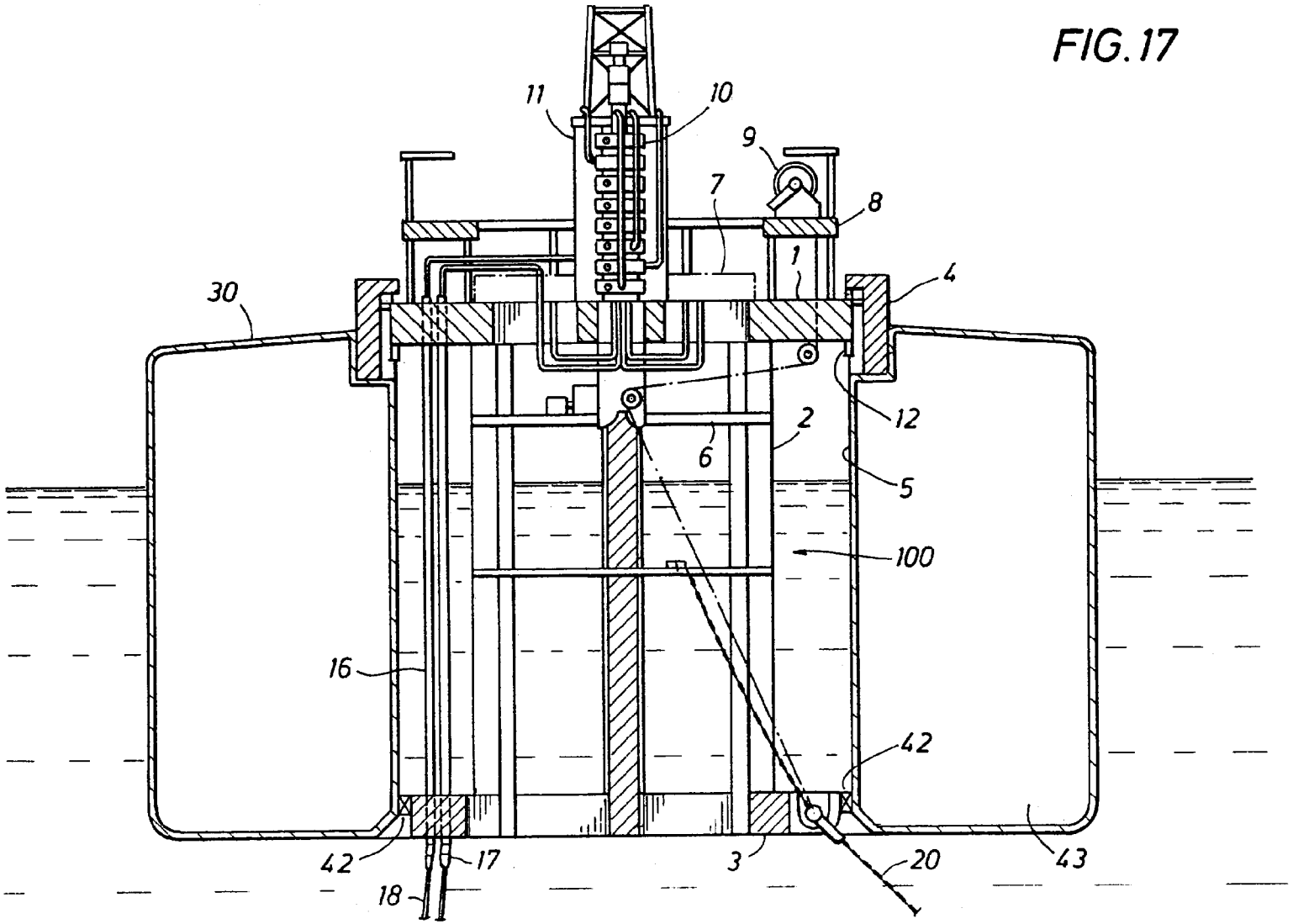
FIG. 17 shows an alternative embodiment of the invention with a transverse cross section view of a turret and vessel and illustrating a flexible frame structure turret supported by an upper bearing at the main deck of the vessel, and by a lower bearing near the vessel keel.

FIG. 17 illustrates an alternative embodiment of the invention where a lower bearing 42 is provided to transfer horizontal load from chain table 3 into vessel hull structure 43 near keel level. This arrangement is advantageous for mooring conditions where large horizontal loads exist that tend to overturn the turret frame 100. Lower bearing 42 comprises a plurality of lubricated individual bearing units which slide on a prepared corrosion resistant surface inside turret insert tube 5. This arrangement takes advantage of the horizontal flexibility of the turret frame 100 to compensate for misalignment and non-concentricity of the upper and lower bearings thereby preventing consequential overload of either the lower bearing or the upper bearing.

Figure 18:
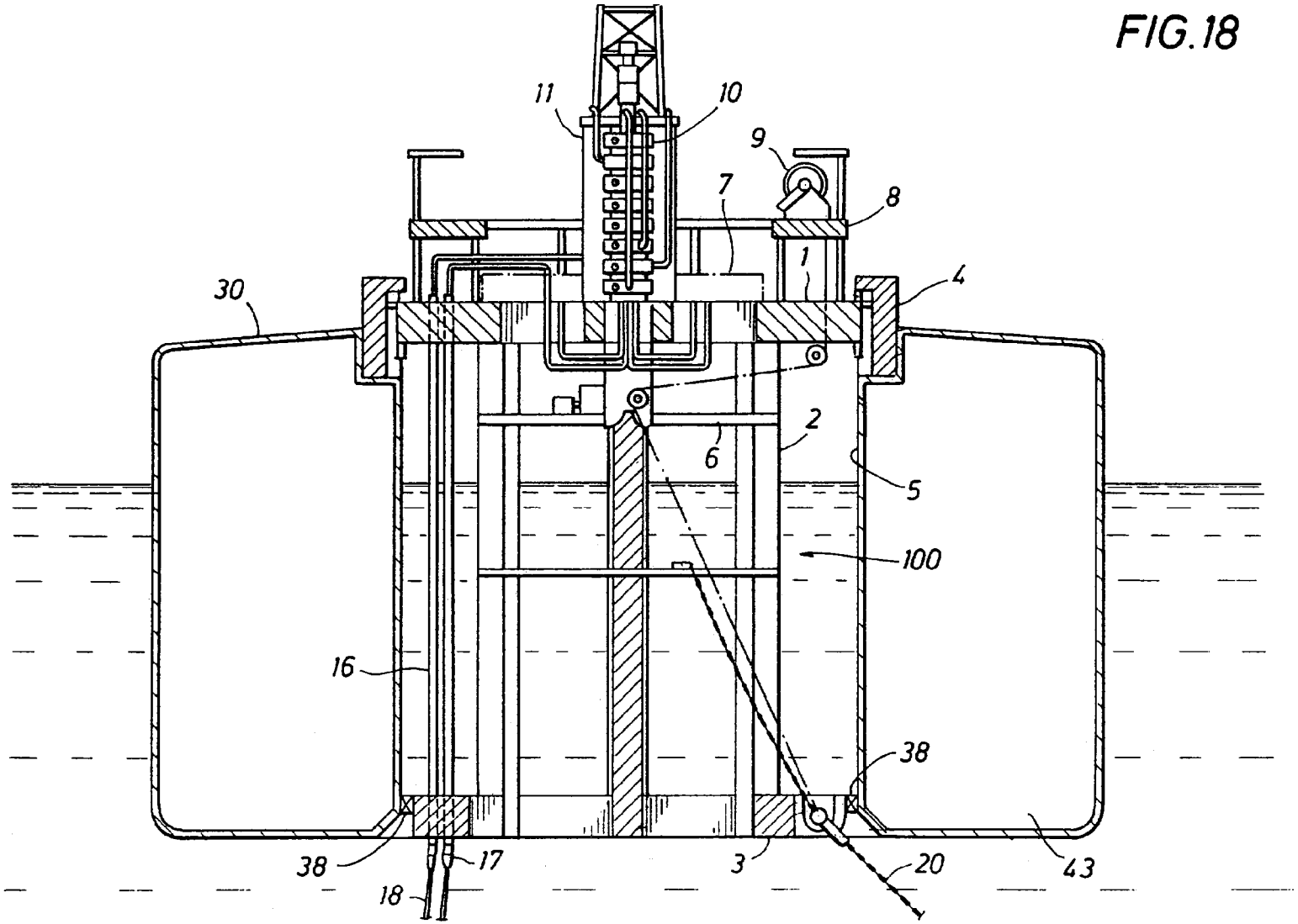
FIG. 18 shows another embodiment of the invention in a transverse cross section view of a turret and vessel, and illustrates a turret having a flexible frame structure which is rotatably supported by an upper bearing at the main deck of the vessel, and an elastomeric bumper pad near the vessel keel.

FIG. 18 illustrates another alternative arrangement where elastomeric bumper pad 38 transfers horizontal load from chain table 3 into vessel hull structure 43 near keel level. This arrangement is advantageous for mooring conditions causing large but infrequent horizontal loads that tend to overturn the turret frame. A plurality of bumper pads 38 restrains chain table 3 when the elastic deflections of the turret frame exceed a desired limit such as about 100 millimeters.

FIG. 19 illustrates another embodiment of the turret frame where a plurality of riser tubes 16 provide structural connection of chain table 3 to main deck 1. In this arrangement, riser tubes 16 transfer all loads from chain table 3 to main deck 1 thereby making the pillars 2 unnecessary.

Figure 20:
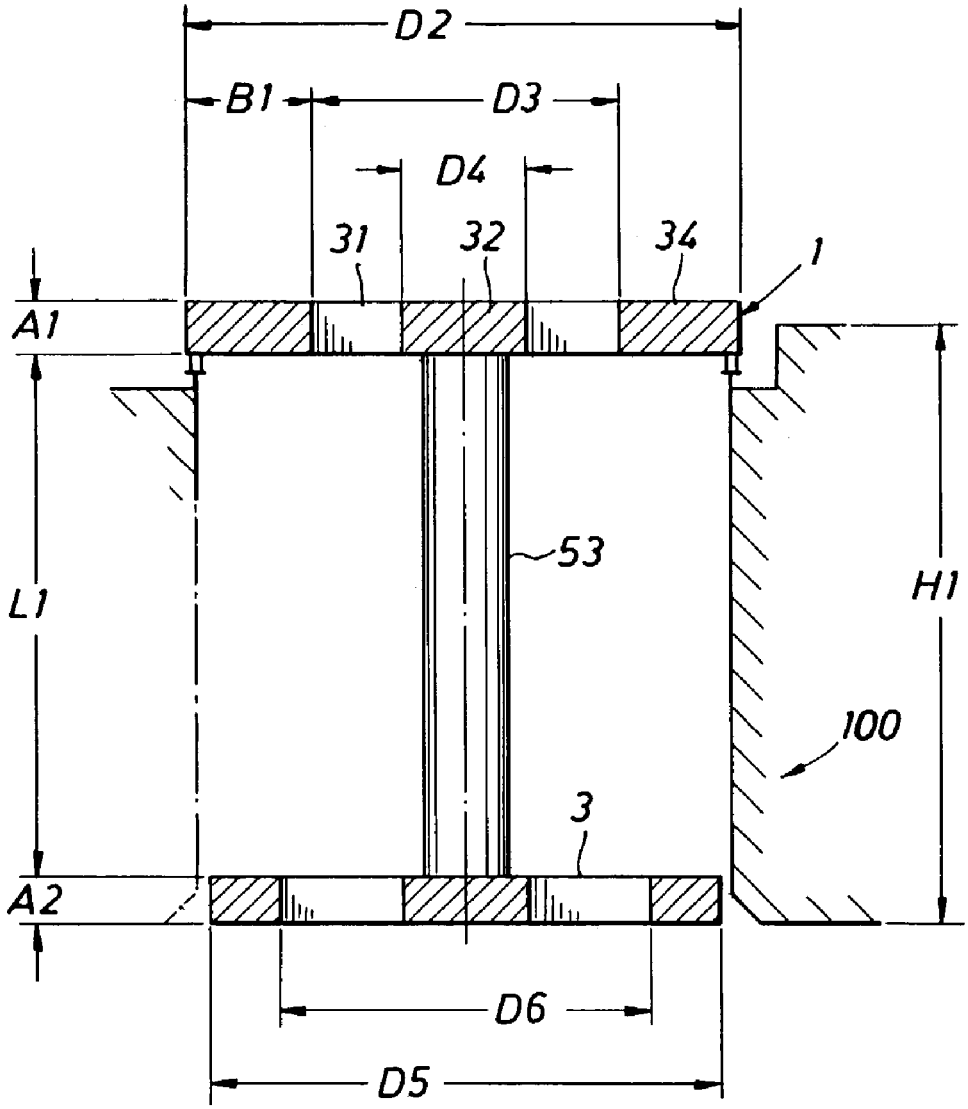
FIG. 20 shows another embodiment of the invention with a transverse section view of a turret where the turret main deck is connected to the chain table by a small diameter tube.

FIG. 20 depicts another embodiment of the turret frame where a single central tube or column 53 connects chain table 3 to turret main deck 1 instead of multiple pillars 2 as shown in FIG. 6. This arrangement can be advantageous when the moonpool diameter D1 is in the range of 14 meters to 20 meters.

What is claimed is:

1. In a vessel-turret assembly including a moonpool (5) in a vessel hull structure (43) and a turret rotatably supported within said moonpool by an axial bearing structure that includes vertical wheels (12) between an upper circular rail (26U) mounted on said turret and a lower circular rail (26B) mounted on said vessel hull structure (43), wherein said lower rail (26B) deflects due to vessel hull structure sagging in response to environmental forces, an improved turret (100) characterized by, a turret main deck (1) to which said upper circular rail is mounted, a chain table (3) separated vertically from said main deck (1) and arranged and designed for coupling with anchor legs which extend to the sea floor, and a connecting structure connected between said turret main deck (1) and said chain table (3), said turret arranged and designed to have a flexibility such that said upper circular rail (26U) substantially conforms in deflection with said lower circular rail (26B) when said vessel sags in response to vertical force acting on said turret.

2. The vessel-turret assembly of claim 1 wherein, said turret main deck (1) includes an outer ring (34), a center ring (32), and a plurality of radial beams (31) which connect said center ring (32) with said outer ring (34).

3. The vessel-turret assembly of claim 2 wherein, six radial beams (31) connect said center ring (32) with said outer ring (34).

4. The vessel-turret assembly of claim 2 wherein, said connecting structure includes at least three pillars (2) each one of which is connected to a radial beam (31) of said turret main deck (1).

5. The vessel-turret assembly of claim 4 wherein, said upper circular rail (26U) is mounted on said outer ring (34) of said turret main deck (1).

6. The vessel-turret assembly of claim 5 wherein, said upper circular rail is mounted on a bottom facing surface of said outer ring (34) of said turret main deck (1), and said assembly further comprises a bearing foundation structure (4) coupled between said vessel structure and an upper facing surface of said outer ring (34) of said turret main deck (1).

7. The vessel-turret assembly of claim 6 further comprising, a radial bearing structure that includes horizontal wheels (13) urged against a circular rail (26R) disposed on said outer ring (34) of said turret main deck (1) by a radial spring assembly (15) mounted on said bearing foundation structure (4).

8. The vessel-turret assembly of claim 6 further comprising, vertical uplift wheels disposed between upper and lower rails (26U', 26B') mounted on said bearing foundation structure (4) and said upper facing surface of said outer ring (34).

9. The vessel-turret assembly of claim 4 further comprising, a plurality of riser tubes (16) connected between said outer ring (34) of said turret main deck (1) and said chain table (3), where said riser tubes are arranged on two outer concentric circles at each of said outer ring (34) and said chain table (3), and where said at least three pillars (2) are connected to said radial beams (31) and to said chain table (3) on inner concentric connection circles having a radius smaller than said two outer concentnc circles.

10. The vessel-turret assembly of claim 2 further comprising, a plurality of riser tubes (16) connected between said outer ring (34) of said turret main deck (1) and said chain table (3).

11. The vessel-turret assembly of claim 10 wherein, said plurality of riser tubes (16) are mounted to said chain table (3) with each riser tube (16) including a riser tube slip joint (25) mounted at said outer ring (34) of said turret main deck (1).

12. The vessel-turret assembly of claim 10 wherein, said plurality of riser tubes (16) are hanging riser tubes (45) connected to said outer ring (34) of said turret main deck (1).

13. The vessel-turret assembly of claim 10 wherein, a product swivel (10) is mounted on said center ring (32), and fluid flow paths are provided between said plurality of riser tubes (16) at said outer ring (34) and said product swivel (10).

14. The vessel-turret assembly of claim 10 wherein, a winch deck (8) is mounted on said outer ring (34) by a support frame.

15. The vessel-turret assembly of claim 2 wherein, said turret main deck (1) of said improved turret (100) is characterized by a thickness distance A1, said upper circular rail (26U) and said lower circular rail (26B) are characterized by a rail diameter distance D1, a predetermined maximum deflection of said upper circular rail (26U) caused by conforming to deflection of said lower circular said rail (26B) due to vessel sagging is characterized by a distance $\delta$, and said turret main deck (1), said chain table (3) and said connecting structure are cooperatively designed and arranged so that the ratios $\delta$/D1 and A1/D1 for an improved turret design fall within a region A defined on a graphical plot of $\delta$/D1 versus A1/D1 where A1/D1 values are between 0.05 and 0.150, and $\delta$/D1 are below lines connecting points A1/D1=0.05, $\delta$/D1=0.001 and A1/D1=0.100, $\delta$/D1=0.0005; and A1/D1=0.100, $\delta$/D1=0.0005 and A1/D1=0.150, $\delta$/D1=0.00035.

16. The vessel-turret assembly of claim 15 wherein, said turret main deck (1) of said improved turret (100) is characterized by an outer diameter D2, and said turret (100) is designed and arranged so that a ratio of D2/D1 is greater than or equal to a minimum number 1.00 and less than or equal to a maximum number 1.30.

17. The vessel-turret assembly of claim 16 wherein, said turret main deck (1) of said improved turret (100) is characterized by an inner diameter D3 of said outer ring (34), and said turret (100) is designed and arranged so that a ratio of D3/D1 is greater than or equal to a minimum number 0.40 and less than or equal to maximum number 0.70.

18. The vessel-turret assembly of claim 17, wherein, said turret main deck (1) is characterized by a diameter D4 of said center ring, and said turret (100) is designed and arranged so that a ratio of D4/D1 is equal to or greater than a minimum number 0.15 and less than or equal to a maximum number 0.25.

19. The vessel-turret assembly of claim 18 wherein, said chain table (3) is in the shape of a ring and is characterized by an outer diameter D5, and said turret (100) is designed and arranged so that a ratio D5/D1 is equal to or greater than a minimum number 0.70 and is less than or equal to a maximum number 1.20.

20. The vessel-turret assembly of claim 19 wherein, said chain table (3) is characterized by an inner diameter D6, and said turret (100) is designed and arranged so that a ratio D6/D5 is greater than or equal to a minimum number 0.60 and is less than or equal to a maximum number 0.80.

21. The vessel-turret assembly of claim 20 wherein, said chain table (3) is characterized by a thickness distance A2, and said turret is designed and arranged so that a ratio of A2/D5 is equal to or greater than 0.05 and equal to or less than 0.15.

22. The vessel-turret assembly of claim 21 wherein, said connecting structure includes at least three pillars (2) and said at least three pillars (2) are characterized by the length L1 between said main deck (1) and said chain table (3), and said turret is designed and arranged so that a ratio of L1/D1 is equal to or greater than 0.70 and equal to or greater than 2.00.

23. The vessel-turret assembly of claim 22 wherein, each of said at least three pillars (2) are tubular in shape and characterized by an outer wall width diameter W1, and said turret is designed and arranged so that a ratio of W1/L1 is greater than or equal to 0.06 and less than or equal to 0.15.

24. The vessel-turret assembly of claim 23 wherein, each of said at least three pillars (2) are tubular in shape and characterized by a wall thickness T1, and said turret is designed and arranged so that a ratio of T1/W1 is greater than or equal to 0.01 and less than or equal to 0.03.

25. The vessel-turret assembly of claim 1 wherein, said chain table (3) is ring-like with an open center.

26. The vessel-turret assembly of claim 1 wherein, a pump deck (6) is mounted to said connecting structure beneath said turret main deck (1) and above said chain table (3), and a chemical tank (35) and chemical pump unit (36) are mounted on said pump deck (6).

27. The vessel-turret assembly of claim 1 wherein, said connecting structure consists of riser tubes (16).

28. The vessel-turret assembly of claim 1 wherein, a chain installation deck (40) is mounted to said connecting structure above said chain table (13).

29. The vessel-turret assembly of claim 1 further comprising, a radial bearing disposed between said chain table (3) and said moonpool (5).

30. The vessel-turret assembly of claim 1 further comprising, an elastomeric bumper pad (38) disposed between said chain table (3) and said moonpool (5).

31. A turret for mooring a vessel comprising, a turret main deck (1), an axial bearing structure (26U) mounted on said main deck, a structure connected to said turret main deck, where said structure is arranged and designed for coupling of anchor legs and risers, said turret main deck characterized by flexibility parameters δ/D1 and A1/D1, where A1 represents a thickness of said turret main deck, D1 represents a diameter of said axial bearing structure mounted on said main deck, δrepresents a predetermined maximum deflection of said axial bearing structure, and said parameters δ/D1 and A1/D1 fall within a region A defined on a graphical plot of δ/D1 versus A1/D1 where A1/D1 values are between 0.05 and 0.150, and δ/D1 are below lines connecting points A1/D1=0.05, δ/D1=0.001 and A1/D1=0.100, δ/D1=0.0005; and A1/D1=0.100, δ/D1=0.0005 and A1/D1=0.150, δ/D1=0.00035.

32. A turret vessel arrangement comprising a vessel having a moonpool with a vessel bearing surface, a turret disposed in said moonpool and having a flexible main deck with a main deck bearing surface, bearing members placed between said vessel bearing surface and said main deck bearing surface, a flexible structure connected to said flexible main deck, where said structure is arranged and designed to couple anchor legs and at least 40 risers, said main deck and said structure being cooperatively arranged and designed such that said main deck bearing surface flexes due to vertical forces acting on said main deck from said anchor legs and said risers, so that said main deck bearing surface conforms with a sagging shape of said vessel bearing surface when said vessel sags in response to sea forces.

33. The turret of claim 32 wherein, said flexible structure includes a chain table and riser tubes which connect the chain table to the main deck.

34. The turret of claim 32 wherein, said flexible structure includes a chain table and a single cylindrical tube which connects the chain table to the main deck.

35. The turret of claim 32 wherein, said flexible structure includes a chain table and at least three pillars which connect the chain table to the main deck.

* * * * *

UNITED STATES PATENT AND TRADEMARK OFFICE

CERTIFICATE OF CORRECTION

PATENT NO. : 6,990,917 B2
APPLICATION NO. : 10/325122
DATED : January 31, 2006
INVENTOR(S) : L. Terry Boatman et al.

It is certified that error appears in the above-identified patent and that said Letters Patent is hereby corrected as shown below:

Column 12,
Line 31, after "parameter", delete "d" and insert -- $\delta$ --.

Signed and Sealed this

Twenty-seventh Day of June, 2006

JON W. DUDAS
*Director of the United States Patent and Trademark Office*